US006144349A

United States Patent [19]

Awata et al.

[11] Patent Number: 6,144,349

[45] Date of Patent: Nov. 7, 2000

[54] PLASMA DISPLAY DEVICE

[75] Inventors: Yoshimasa Awata; Naoki Matsui; Kenji Awamoto; Yoshikazu Kanazawa; Shigetoshi Tomio; Fumitaka Asami; Masaya Tajima; Hideki Isohata; Junichi Okayasu; Kiyoshi Takata; Takashi Fujisaki, all of Kawasaki, Japan

[73] Assignee: Fujitsu Limited, Kawasaki, Japan

[21] Appl. No.: 09/035,923

[22] Filed: Mar. 6, 1998

[30] Foreign Application Priority Data

Sep. 1, 1997 [JP] Japan ..... 9-236371

[51] Int. Cl.[7] ..... G09G 3/28

[52] U.S. Cl. ..... 345/67; 345/60; 345/61; 345/62; 345/66; 345/68; 345/103

[58] Field of Search ..... 345/60–62, 66–68, 345/80, 99, 103

[56] References Cited

U.S. PATENT DOCUMENTS

| | | | |
|---|---|---|---|
| 4,180,762 | 12/1979 | Weber | 315/169.4 |
| 4,320,418 | 3/1982 | Pavliscak | 348/797 |
| 5,030,888 | 7/1991 | Salavin et al. | 315/169.4 |
| 5,331,252 | 7/1994 | Kim | 315/169.4 |
| 5,369,338 | 11/1994 | Kim | 315/169.4 |
| 5,790,087 | 8/1998 | Shigeta et al. | 345/67 |
| 5,854,540 | 12/1998 | Matsumoto et al. | 315/169.1 |
| 5,877,734 | 3/1999 | Amemiya | 345/60 |
| 6,037,916 | 3/2000 | Amemiya | 345/60 |

FOREIGN PATENT DOCUMENTS

| | | |
|---|---|---|
| 0762373 A2 | 3/1997 | European Pat. Off. . |
| 10-3280 | 1/1998 | Japan . |
| 10-187091 | 7/1998 | Japan . |
| 2266007 | 10/1993 | United Kingdom . |

*Primary Examiner*—Richard A. Hjerpe
*Assistant Examiner*—Henry N. Tran
*Attorney, Agent, or Firm*—Staas & Halsey LLP

[57] ABSTRACT

The present invention relates to a plasma display device which limits a generation of electromagnetic wave. The plasma display device has first and second drive circuits for applying a drive voltage to first and second display electrode pair. Further, a direction of a charge current flowing at said first display electrode pair when said drive voltage is applied by said first drive circuit is opposite on said plasma display panel to a direction of a charge current flowing at said second display electrode pair when said drive voltage is applied by said second drive circuit. According to the present invention, a transitional charge/discharge current, which is generated upon the application of a drive voltage to one of the display electrodes, and a light emission discharge current flow in opposite directions on the panel. Thus, electromagnetic waves that are generated by the inductances of the display electrode pair cancel each other out. In addition, the currents flowing in opposing directions cancel each other out on the common ground wirings which are connected to the ground wirings of the drive circuits, and electromagnetic wave is reduced.

23 Claims, 21 Drawing Sheets

OVERALL STRUCTURE OF PLASMA DISPLAY DEVICE

OVERALL STRUCTURE OF PLASMA DISPLAY DEVICE

VOLTAGE WAVEFORM APPLIED TO ELECTRODES

TIMING CHART FOR FIG.6

FOR CONVENTIONAL

FOR INVENTION

PLASMA DISPLAY DEVICE

BACKGROUND OF THE INVENTION

1. Field of the Invention

The present invention relates to a display device using a plasma display panel (PDP), and in particular to a plasma display panel in which an electromagnetic wave can be restricted that occurs when a drive voltage, such as a sustain voltage, is applied to a pair of display electrodes.

2. Related Arts

The focus is now on the use of plasma display panels (hereinafter referred to merely as PDPs) as a large screen full color display device. For a tri-electrode surface discharge type AC PDP especially, a plurality of display electrode pairs are formed to generate a surface discharge on a substrate near the display side, and address electrodes that intersect the display electrode pairs and a fluorescent layer for covering the electrodes are formed on a substrate on the rear side. To drive the PDP, basically, a large voltage is applied to the display electrode pairs to reset them, a discharge is performed between one electrode of the display electrode pair and an individual address electrode, a sustain voltage is applied between the display electrode pair, and a wall charge generated by the discharge is employed to generate a sustain discharge between the display electrodes.

FIG. 20 is a schematic diagram illustrating a conventional plasma display device. Display electrode pairs X1, Y1, X2 and Y2 are formed in parallel on a PDP 1. Address electrodes (not shown) are disposed perpendicular to the display electrode pairs. X electrodes are driven by a common drive circuit 2, and Y electrodes are driven by a Y electrode drive circuit 3, which can drive the Y electrodes independently. A sustain discharge voltage is applied to the X and Y electrodes to produce a sustain discharge.

Upon the application of the sustain discharge voltage, a charge is placed on a spacial capacitor between the X electrode and Y electrode. When a voltage exceeding a specific discharge voltage is generated between the electrodes, a sustain discharge occurs. Therefore, when the sustain discharge voltage is applied between the two electrodes, equally, current I flows to the two electrodes. The example in FIG. 20 shows the condition when the sustain discharge voltage is applied to the Y electrode by the Y electrode drive circuit 3. In this case, the X electrode is grounded.

In conventional plasma display device, the Y electrode drive circuit and the X electrode drive circuit are provided at either end of the panel 1. Thus, for example, a charge current that accompanies the application of the sustain voltage flows in one direction at one time, as is shown in FIG. 20. The sum of such a current flows in the opposite direction along the ground wiring between the two drive circuits. The sum of the current is very large, and even when the ground wiring has sufficient width and thickness, a very large electromagnetic wave is generated by passing the total current across an inductance $L_{GND}$ included in the ground wiring. Further, the X electrode and the Y electrode also have inductances L1 and L2. Their inductances L1, L2 are comparatively large, and even when a current I flowing across the individual electrodes is small, a comparatively large electromagnetic wave is produced.

An electromagnetic wave generated by a plasma display device is large at a frequency lower than a frequency of 30 MHz to 1 GHz, which is to be regulated. If the electromagnetic wave carries a great amount of energy, even though at a low frequency, this is undesirable because the erroneous operation of a peripheral device may result.

In addition, in the conventional plasma display device, a panel 1 on which display electrodes are formed is connected by a cable to external circuit boards on which mounted integrated circuits, including drive circuits. At one side of the panel 1 is provided a Y electrode drive circuit 3, which can independently drive the individual Y electrodes. In accordance with recent increases in size and more detailed fabrication, the pitches of the Y electrodes tend to be reduced and the density of the connection electrodes is increased to connect the Y electrodes to the drive circuits. As a result, it is difficult to provide wiring between integrated circuits (IC) in the Y electrode drive circuit and electrodes for the connection of the Y electrodes. The arrangement of the conventional drive circuits will not be suitable for further detailed fabrication.

SUMMARY OF THE INVENTION

It is, therefore, one object of the present invention to provide a plasma display device that can limit the occurrence of electromagnetic waves.

It is another object of the present invention to provide a plasma display device that can reduce the density of connection electrodes disposed between an electrode drive circuit and a display panel.

To achieve the above objects, according to the present invention, a plasma display device, having a first insulating substrate on which are formed a plurality of display electrode pairs, and a second insulating substrate on which a plurality of address electrodes are formed so as to intersect said display electrode pairs, said first and said second insulating substrates being located opposite each other with an intervening discharge space therebetween, said plural display electrode pairs including a plurality of first display electrode pairs and a plurality of second display electrode pairs, said plasma display panel comprising:

a first drive circuit for applying a drive voltage to said first display electrode pair; and a second drive circuit for applying a drive voltage to said second display electrode pair, wherein a direction of a charge current flowing at said first display electrode pair when said drive voltage is applied by said first drive circuit is opposite on said plasma display panel to a direction of a charge current flowing at said second display electrode pair when said drive voltage is applied by said second drive circuit.

According to the present invention, a transitional charge/discharge current, which is generated upon the application of a drive voltage to one of the display electrodes, and a light emission discharge current flow in opposite directions on the panel. Thus, electromagnetic waves that are generated by the inductances of the display electrode pair cancel each other out. In addition, the currents flowing in opposing directions cancel each other out on the common ground wirings which are connected to the ground wirings of the drive circuits, and no electromagnetic wave is generated. As a result, the generation of electromagnetic waves at the plasma display device can be limited.

Furthermore, according to the present invention, a plasma display device, having a first insulating substrate on which are formed a plurality of display electrode pairs, and a second insulating substrate on which a plurality of address electrodes are formed so as to intersect said display electrode pairs, said first and said second insulating substrates being located opposite each other with an intervening discharge space therebetween, said plural display electrode pairs including Y electrodes and X electrodes, said display electrode pairs alternately discharging from one electrode to the other electrode, or vice versa, during a first period and during a second period;

said plasma display panel comprising:

a first drive circuit, provided at one side of said display electrode pairs of said plasma display panel, for applying a drive voltage to odd numbered Y electrodes during said first period;

a second drive circuit, provided at the other side of said display electrode pairs of said plasma display panel, for applying a drive voltage to odd numbered X electrodes during said second period;

a third drive circuit, provided at one side of said display electrode pairs of said plasma display panel, for applying a drive voltage to even numbered X electrodes during said second period; and a fourth drive circuit, provided at the other side of said display electrode pairs of said plasma display panel, for applying a drive voltage to even numbered Y electrodes during said first period.

According to the present invention, when a drive voltage, such as a sustain voltage, is applied between the odd numbered electrodes and between the even numbered electrodes of the display electrode pairs, charge currents flow in opposite directions and electromagnetic waves generated by adjacent display electrode pairs efficiently cancel each other out. According to the present invention, since the Y electrode drive circuit that must drive independently, the Y electrodes can be divided into two parts separately positioned on opposite sides of the panel, the density of the wiring between the Y electrode connection electrodes and the output terminals of the Y electrode drive circuits on the circuit board, on which the drive circuits are mounted, can be reduced. Further, the number of display electrode pairs can be increased to provide a higher density pixels display device.

DETAILED DESCRIPTION OF THE PREFERRED EMBODIMENTS

The preferred embodiments of the present invention will now be described while referring to the accompanying drawings. The technical scope of the present invention, however, is not limited to these embodiments.

Figure 1:
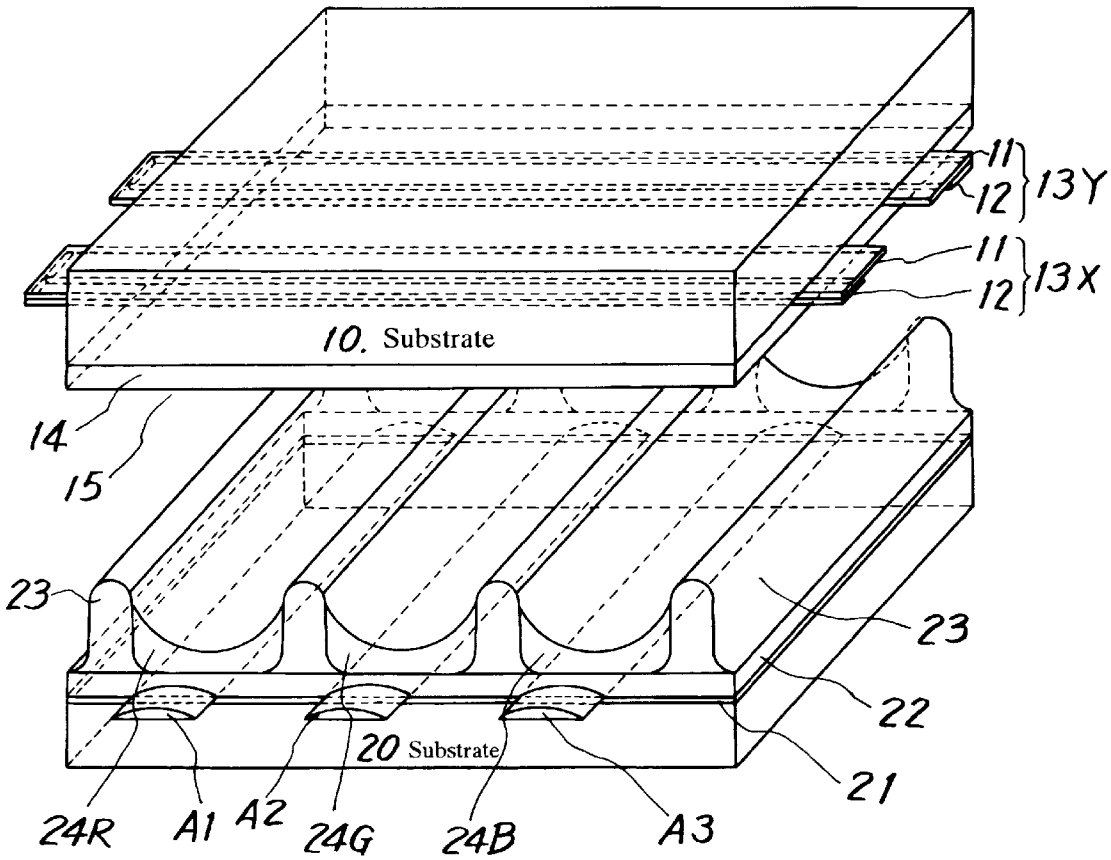
FIG. 1 is an exploded perspective view of a PDP.
Figure 2:
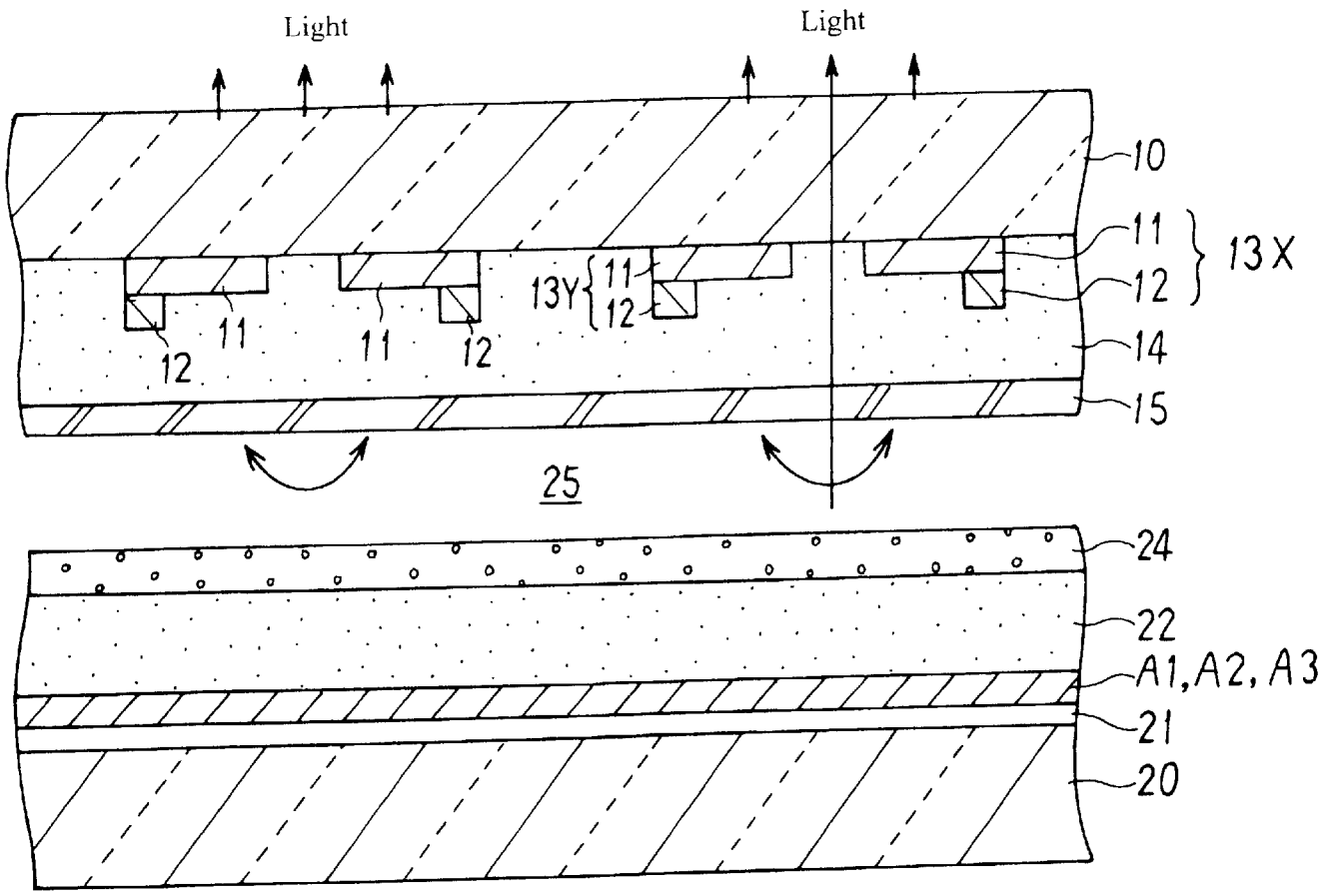
FIG. 2 is a cross-sectional view of the PDP.

FIG. 1 is an exploded perspective view of a PDP, and FIG. 2 is a cross-sectional view of the PDP. The structure of the PDP will be described while referring to FIGS. 1 and 2. Located on the display side is a glass substrate 10 through which light passes in the direction shown in FIG. 2. Located on the rear is a glass substrate 20. On the glass substrate 10 on the display side are formed X electrodes 13X and Y electrodes 13Y, each of which comprises a transparent electrode 11 and a highly conductive bus electrode 12 mounted on the electrode 11 (under it in the drawings). The X electrodes 13X and the Y electrodes 13Y are covered by a dielectric layer 14 and a protective layer 15 made of MgO. The bus electrodes 12 are located along the facing ends of the X electrodes and the Y electrodes in order to compensate for the conductivity of the transparent electrodes 11.

An underlayer passivation film 21 made of, for example, silicone oxide film is formed on the glass substrate 20 on the rear, and address electrodes A1, A2 and A3, each of which has a strip-like shape, are formed on the film 21 and are covered with a dielectric layer 22. Further, partition walls (ribs) 23, each of which has a strip-like shape, are formed adjacent to the address electrodes A1, A2 and A3. The partition walls 23 have two functions: to avoid an influence to adjacent cells when the address discharge occurres, and to prevent light crosstalk. Red, blue and green fluorescent materials 24R, 24G and 24B are painted on areas between adjacent ribs 23 so as to cover the address electrodes and the side walls of the ribs 23*x*. As is shown in FIG. 2, the display side substrate 10 and the rear substrate 20 are assembled with a gap 25 of about 100 $\mu$m between them, and a Ne+Xe gas mixture for facilitating discharges is sealed inside the gap 25.

Figure 3:
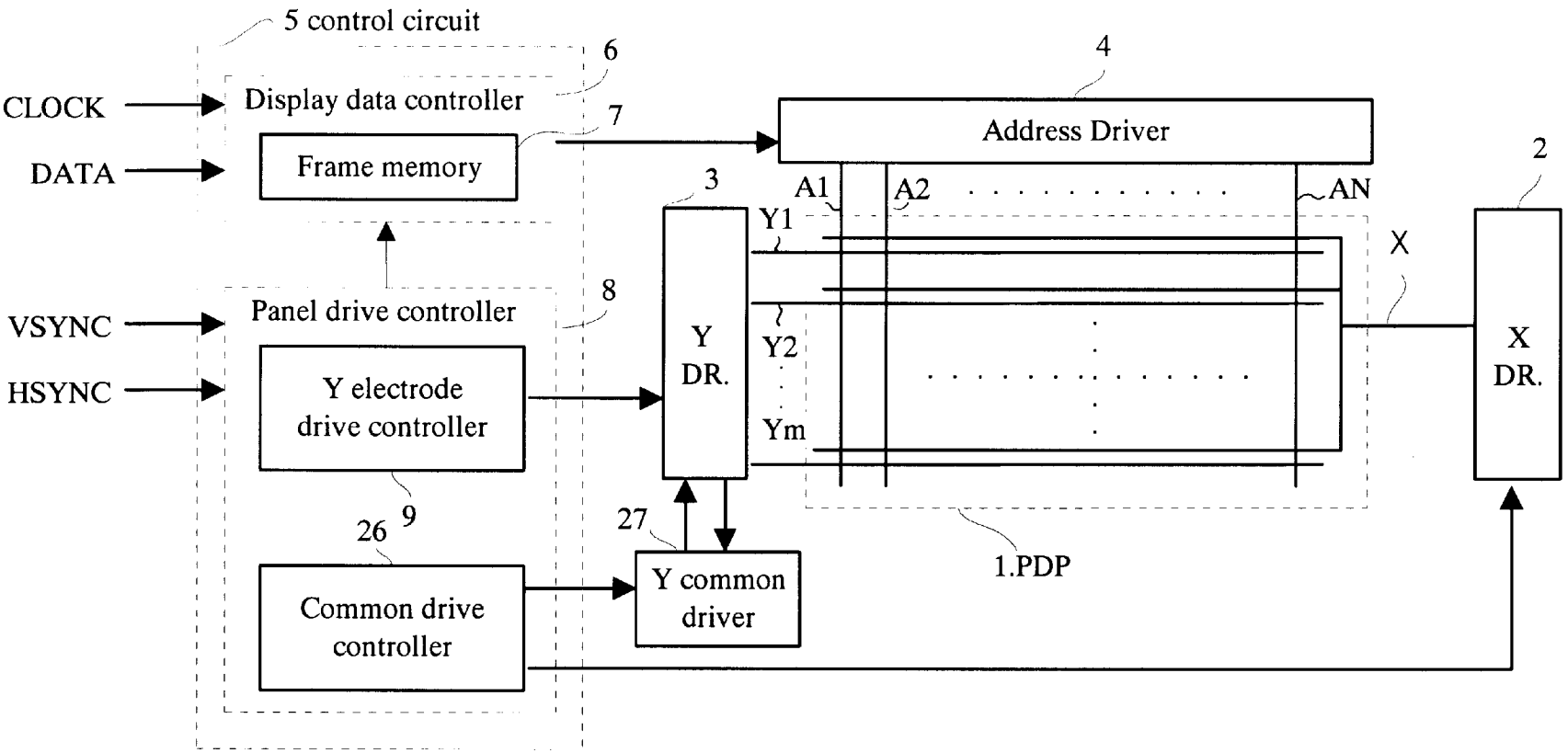
FIG. 3 is a diagram illustrating the overall arrangement of a plasma display device using the tri-electrode surface discharge PDP.

FIG. 3 is a diagram illustrating the overall arrangement of a plasma display device using the above described tri-electrode surface discharge PDP. Parallel pairs of X electrodes and Y electrodes are horizontally provided for a plasma display panel 1. Address electrodes A1 to An are perpendicularly formed relative to the display electrode pairs. X electrodes X are arranged in parallel in the horizontal direction and are commonly connected at one end of the panel 1, while the Y electrodes Y1 to Ym are arranged between the X electrodes and are individually guided to the end of the substrate. These X and Y electrodes are paired to form display lines, and a sustain discharge voltage employed for a display is alternately applied to these pairs.

While a sustain discharge voltage is alternately applied to the paired X and Y electrodes, the Y electrodes are also used as scan electrodes for writing display data. The address electrodes are employed for writing data, and plasma discharges occur between the address electrodes and the Y electrodes that are scanned in accordance with the data content. Therefore, only a discharge current for one cell needs to flow to the address electrodes. Further, since the discharge voltage is determined in accordance with the combination of an address electrode and a Y electrode, it is possible to drive the display panel 1 with a comparatively low voltage.

A plasma display device has a peripheral circuit employed for driving the PDP. A Y electrode drive circuit 3 for driving the Y electrodes, an X electrode drive circuit 2 for driving the X electrodes, and an address driver 4 for driving the address electrodes are provided around the panel 1. The address driver 4 is controlled by a display data controller 6, which has a frame memory 7 and which receives display data DATA. The Y electrode drive circuit 3 and the X electrode drive circuit 2 are controlled by a panel drive controller 8. The panel drive controller 8 receives a vertical sync signal $V_{sync}$ and a horizontal sync signal $H_{sync}$, and at timings synchronous with these sync signals, a Y electrode drive controller 9 and a common drive controller 26 control the respective drive circuits. A common driver 27 on the Y electrode side supplies control voltages to the Y electrode drive circuit 3 that primarily the controls the scan timing.

Figure 4:
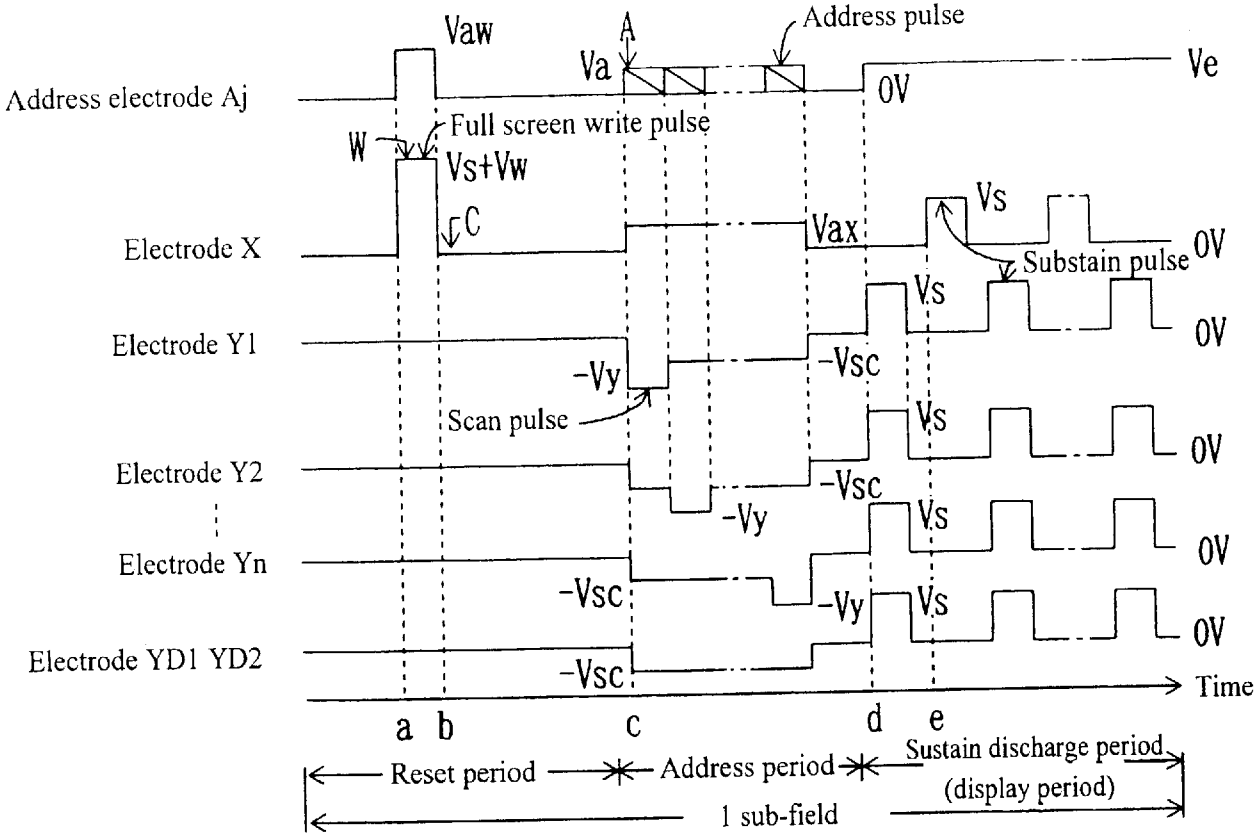
FIG. 4 is a voltage waveform diagram applied to electrodes for explaining a specific PDP drive method.

FIG. 4 is a voltage waveform diagram applied to electrodes for explaining a specific PDP drive method. Voltages to be applied to the electrodes are, for example, Vw=130 V, Vs=180 V, Va=50 V, −Vsc=−50 V and −Vy=−150 V. Vaw and Vax are set to the middle potentials of the voltages to be applied to the other electrodes.

For driving the tri-electrode surface discharge PDP, one sub-field includes a reset period, an address period and a sustain discharge period (display period).

During the reset period, at time a-b, a full screen write pulse is applied to the commonly connected X electrodes, and a discharge occurs between the X-Y electrodes across the entire panel 1 (W in FIG. 4). From among the electric charges generated in the space 25 shown in FIG. 2 by the discharge, positive charges are attracted to the Y electrodes having a low voltage, and negative charges are attracted to the X electrodes having a high voltage. As a result, at time b, at which there is no write pulse, a discharge again occurs between the X and Y electrodes by a high electric field formed of the charges which have been attracted and accumulated on the dielectric layer 14 (C in FIG. 4). Then, all the charges at the X and Y electrodes are neutralized, and the resetting of the panel 1 is completed. Time b-c represents the time required for the neutralization of the charges.

Next, during the address period, −50 V (−Vsc) is applied to the Y electrodes, 50 V (Vax) is applied to the X electrodes, and a scan pulse of −150 (−Vy) is applied to the Y electrodes sequentially, and an address pulse 50 V (Va), in accordance with the display data, is applied to the address electrodes Aj. As a result, a high voltage of 200 V is applied between the address electrodes Aj and the scan electrodes Y, and a plasma discharge occurs. However, since the scan pulse does not have a high voltage and a large pulse width as the full screen write pulse at the reset time, an opposing discharge due to the accumulated charges will not occur even after the application of the scan pulse is terminated. From among the spacial electric charges generated by the discharge, negative charges are accumulated on the dielectric layers 14 and 22 over the X electrodes 13X and the address electrodes Aj, to which 50 V is applied, and positive charges are accumulated on the dielectric layer 14 over the Y electrodes 13Y, to which −50 V is applied.

The charges accumulated over the X electrodes and Y electrodes serve as a memory function for a sustain discharge during the following sustain discharge period. That is, upon the application of a sustain discharge voltage, which will be described later, to the X and Y electrodes, the sustain pulse voltage is superimposed on the voltage of the accumulated charges between the X and Y electrodes of a cell wherein during the address period the discharge occurs and the charges are accumulated, and the sustain discharge is generated between the X and Y electrodes.

Finally, during the sustain discharge period, the wall charges stored during the address period are employed to perform a display discharge in accordance with the luminance of the display. Specifically, a specific sustain pulse is applied alternately to the X and Y electrodes so that the discharge will occur in a cell having wall charges and will not occur in a cell having no wall charges. As a result, the discharge is repeated alternately between the X and Y electrodes in the cell wherein the charges are accumulated during the address period. The luminance of the display is generated in accordance with the number of the sustain discharge pulses. Therefore, a display with multiple gradations is ensured by repeating the sub-field having weighted sustain discharge periods a plurality of times. A full color display can be implemented by the combination of RGB cells.

Figure 5:
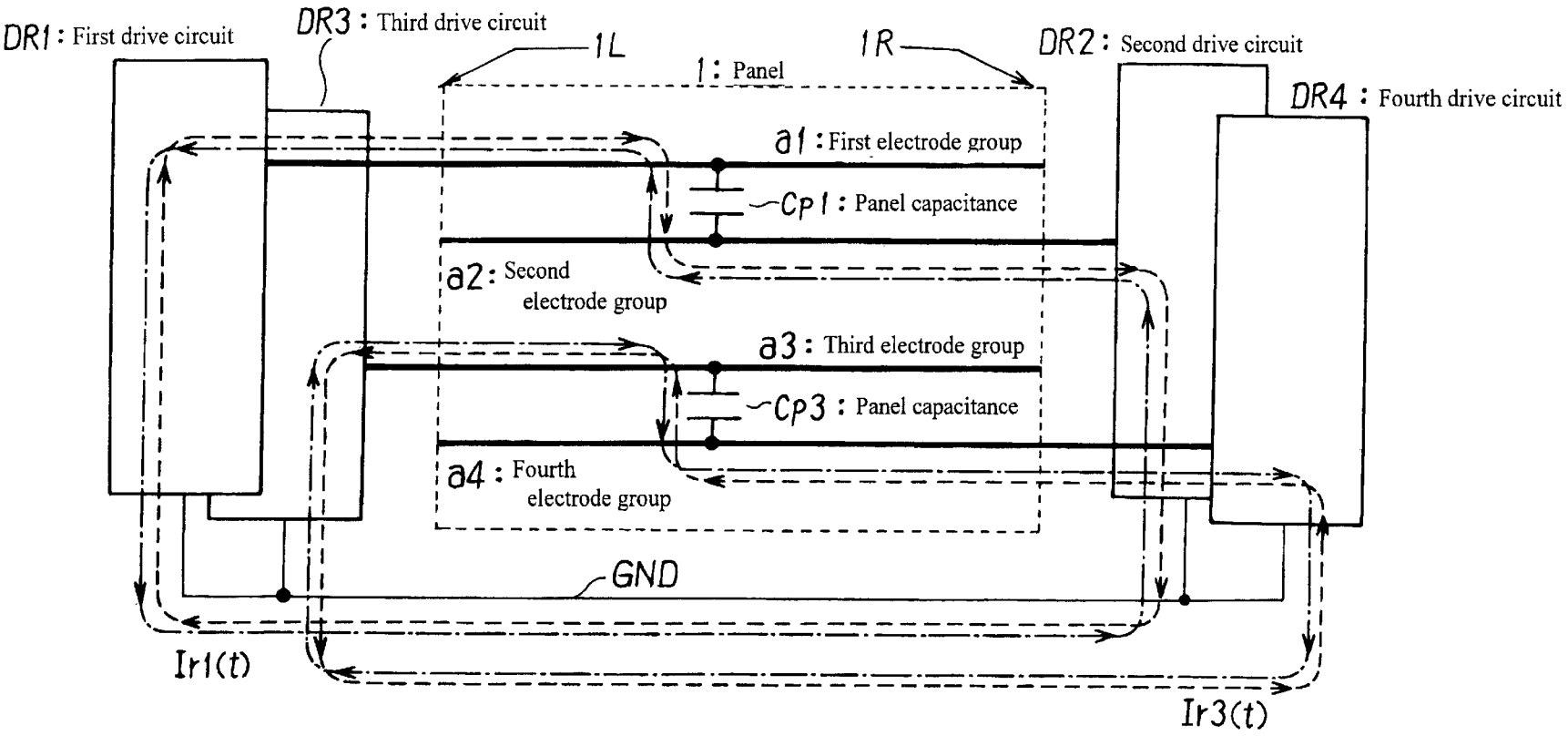
FIG. 5 is a schematic diagram for the preferred embodiment of the present invention.

FIG. 5 is a schematic diagram for the preferred embodiment of the present invention. In this embodiment, X electrodes and Y electrodes constituting display electrode pairs are sorted into a first electrode group a1, a second electrode group a2, a third electrode group a3 and a fourth electrode group a4. The individual electrode groups have a plurality of electrodes, but are simplified by using only a single line for each of them in FIG. 5. A first drive circuit DR1 for driving the first electrode group a1 and a third drive circuit DR3 for deriving the third electrode group a3 are located on the left side 1L of the panel substrate 1. A second drive circuit DR2 for driving the second electrode group a2 and a fourth drive circuit DR4 for driving the fourth electrode group a4 are located on the right side 1R of the panel substrate 1.

With the above arrangement, the first electrode group a1 and the second electrode group a2 constitute display electrode pairs, and the third electrode group a3 and the fourth electrode group a4 constitute display electrode pairs. In addition, the drive circuits DR1 to DR4 drive the corresponding display electrodes so that charge currents Ir1 and Ir3, which accompany the application of the sustain discharge voltage to the electrode pair groups, flow in opposite directions.

Specifically, during a certain phase (during a first period), the first drive circuit DR1 applies the sustain discharge voltage to the first electrode group a1, and the fourth drive circuit DR4 applies the sustain discharge voltage to the fourth electrode group a4, as is indicated by the broken lines in FIG. 5. As a result, current Ir1 (t), which charges a capacitor Cp1 located between the first and the second electrode groups, flows from the left to the right across the electrodes, and flows from the right to the left along a ground line GND (broken line in FIG. 5). Further, current Ir3 (t), which charges a capacitor Cp3 located between the third and the fourth electrode groups, flows from the right to the left across the electrodes, and flows from the left to the right along the ground line GND (broken line in FIG. 5).

During a phase (second period) opposite to the above phase, the second drive circuit DR2 applies the sustain discharge voltage to the second electrode group a2, and the third drive circuit DR3 applies the sustain discharge voltage to the third electrode group a3, as is indicated by the chained lines in FIG. 5. As a result, the current Ir1 (t), which charges the capacitor Cp1 located between the first and the second electrode groups, flows from the right to the left across the electrodes, and flows from the left to the right along the ground line GND (chained line in FIG. 5). Further, the current Ir3 (t), which charges the capacitor Cp3 located between the third and the fourth electrode groups, flows from the left to the right across the electrodes, and flows from the right to the left along the ground line GND (chained line in FIG. 5).

Therefore, the current Ir1 (t) and the current Ir3 (t) flow in opposite directions along the ground line GND and cancel each other out, so that electromagnetic noise, which is caused by a large charge current flowing along the ground line GND, is not generated. In addition, since the currents flow in opposite directions across the individual electrode pairs of the first and second electrode groups and of the third and fourth electrode groups, the vectors for electromagnetic waves generated at these electrodes are also aligned in opposite directions, so that the energy of the electromagnetic waves are spatially canceled out. As a result, in the arrangement where the electrode pairs of the first and the second electrode groups are adjacent to the electrode pairs of the third and the fourth electrode groups, a greater effect can be obtained for the spacial cancellation of electromagnetic waves, which are generated by a charge current flowing across the electrodes.

Figure 6:
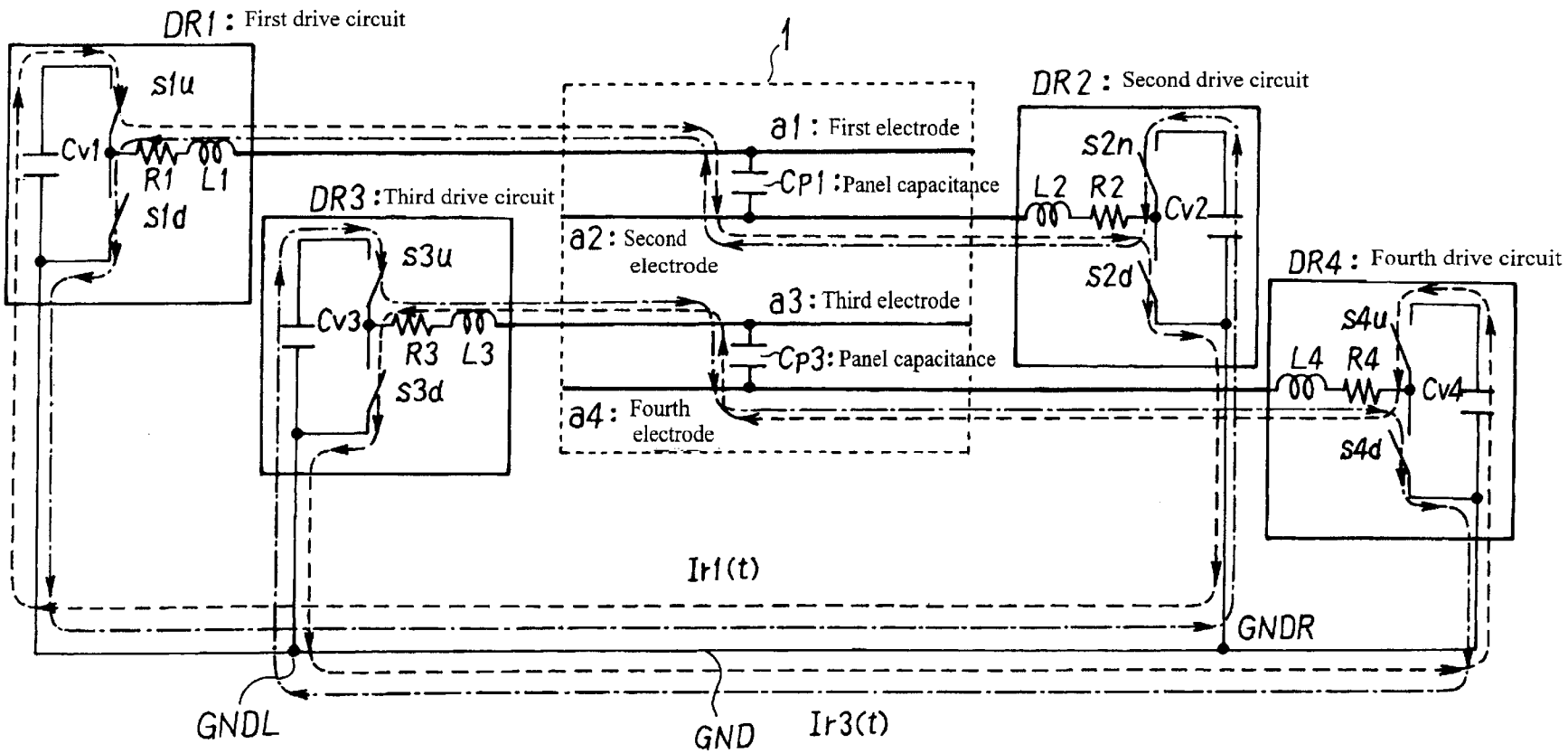
FIG. 6 is a schematic diagram illustrating the embodiment of the present invention.

FIG. 6 is a schematic diagram illustrating the embodiment of the present invention. In FIG. 6 are shown electrodes a1 to a4 for each electrode group and drive circuits DR1 and DR4 for driving them, and the route for the above described current charge is shown in more detail. The drive circuits respectively include power sources Cv1 to Cv4, pull-up devices s1u to s4u, and pull-down devices s1d to s4d, which are constituted by transistors. Parasitic resistors R1 to R4 and parasitic inductances L1 to L4 are provided for electrodes. In this embodiment, the drive circuits DR1 to DR4 and the electrodes a1 to a4 are symmetrically arranged relative to the panel 1.

Figure 7:
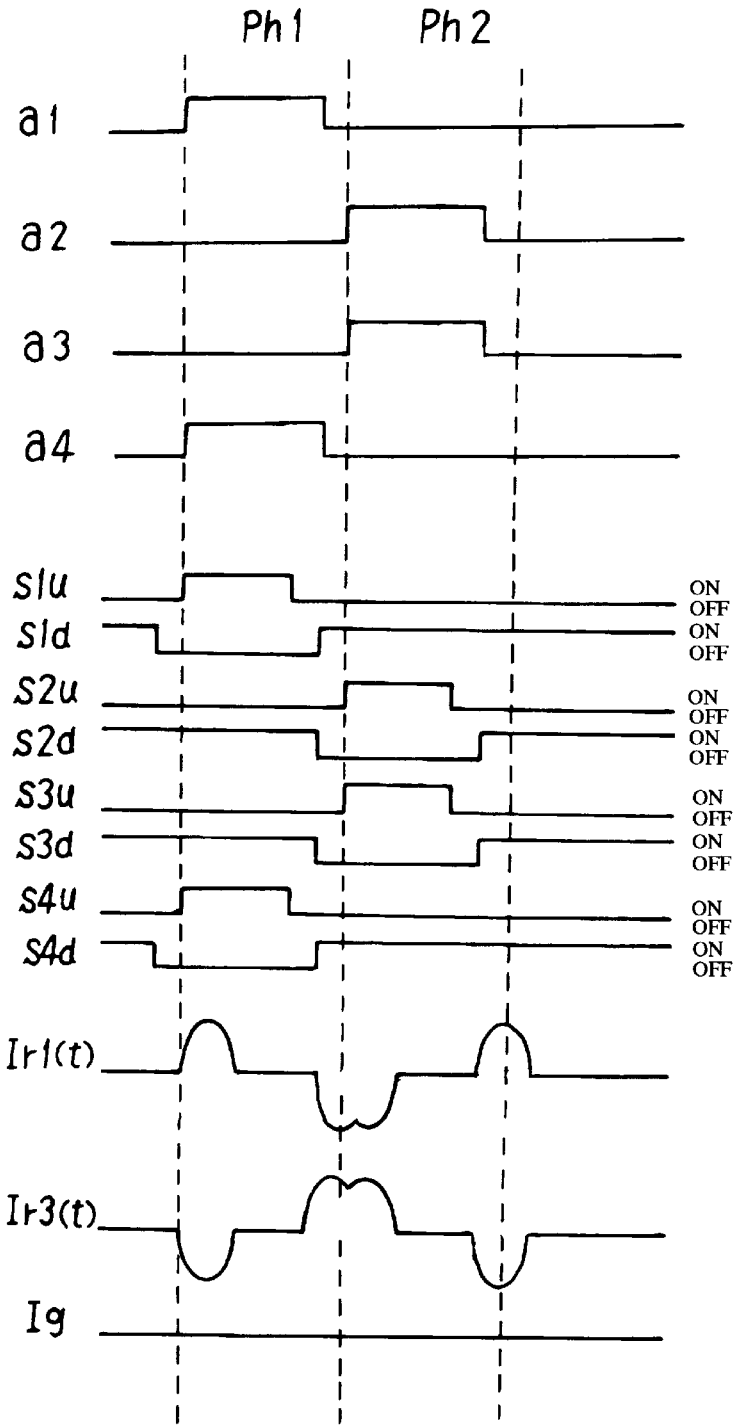
FIG. 7 is a timing chart for the embodiment in FIG. 6.

FIG. 7 is a timing chart for the embodiment in FIG. 6. As is shown in FIG. 7, at the first sustain discharge phase Ph1, a sustain discharge voltage is applied to the first electrode a1 and the fourth electrode a4, and at the second phase Ph2 a sustain discharge voltage is applied to the second electrode a2 and the third electrode a3.

In FIG. 7, the ON/OFF state of s1u, s1d to s4u and s4d are shown. During the first phase (first period) Ph1, the pull-up device s1u of the first drive circuit DR1, is turned on, and the pull-down device s1d is turned off. As a result, the sustain discharge voltage is applied to the first electrode a1, and the pull-up device s1u of the second drive circuit DR2 is turned off and the pull-down device s2d is turned on. Then, the second electrode a2 is grounded. Therefore, as is indicated by the broken line in FIG. 6, the charge current Ir1 (t) between the first and the second electrodes and the charge current Ir3 (t) between the third and the fourth electrodes flow in opposite directions. Assuming that the direction in which the current flows from the right side GNDR of the ground line GND to the left side GNDL (see FIG. 6) is defined as the forward direction, as is shown in FIG. 7, the currents Ir1 (t) and Ir3 (t) have opposite polarities.

During the second phase (second period) Ph2, the operations of the drive circuits are performed in directions opposite to those during the first phase, and the currents Ir1 (t) and Ir3(t) also have opposite polarities, as is shown in FIG. 7.

Among the above described first to the fourth electrode groups, the following combinations of X electrodes and Y electrodes are available.

(1) first electrode group a1: odd numbered Y electrodes
second electrode group a2: odd numbered X electrodes
third electrode group a3: even numbered X electrodes
fourth electrode group a4: even numbered Y electrodes
(2) first electrode group a1: odd numbered Y electrodes
second electrode group a2: odd numbered X electrodes
third electrode group a3: even numbered Y electrodes
fourth electrode group a4: even numbered X electrodes
(3) first electrode group a1: upper Y electrodes
second electrode group a2: upper X electrodes
third electrode group a3: lower X electrodes
fourth electrode group a4: lower Y electrodes
(4) first electrode group a1: upper Y electrodes
second electrode group a2: upper X electrodes
third electrode group a3: lower Y electrodes
fourth electrode group a4: lower X electrodes The odd numbering and even numbering include cases wherein an odd number or an even number is provided for each electrode, and for a set of two electrodes or for a set of a plurality of electrodes.

Figure 8:
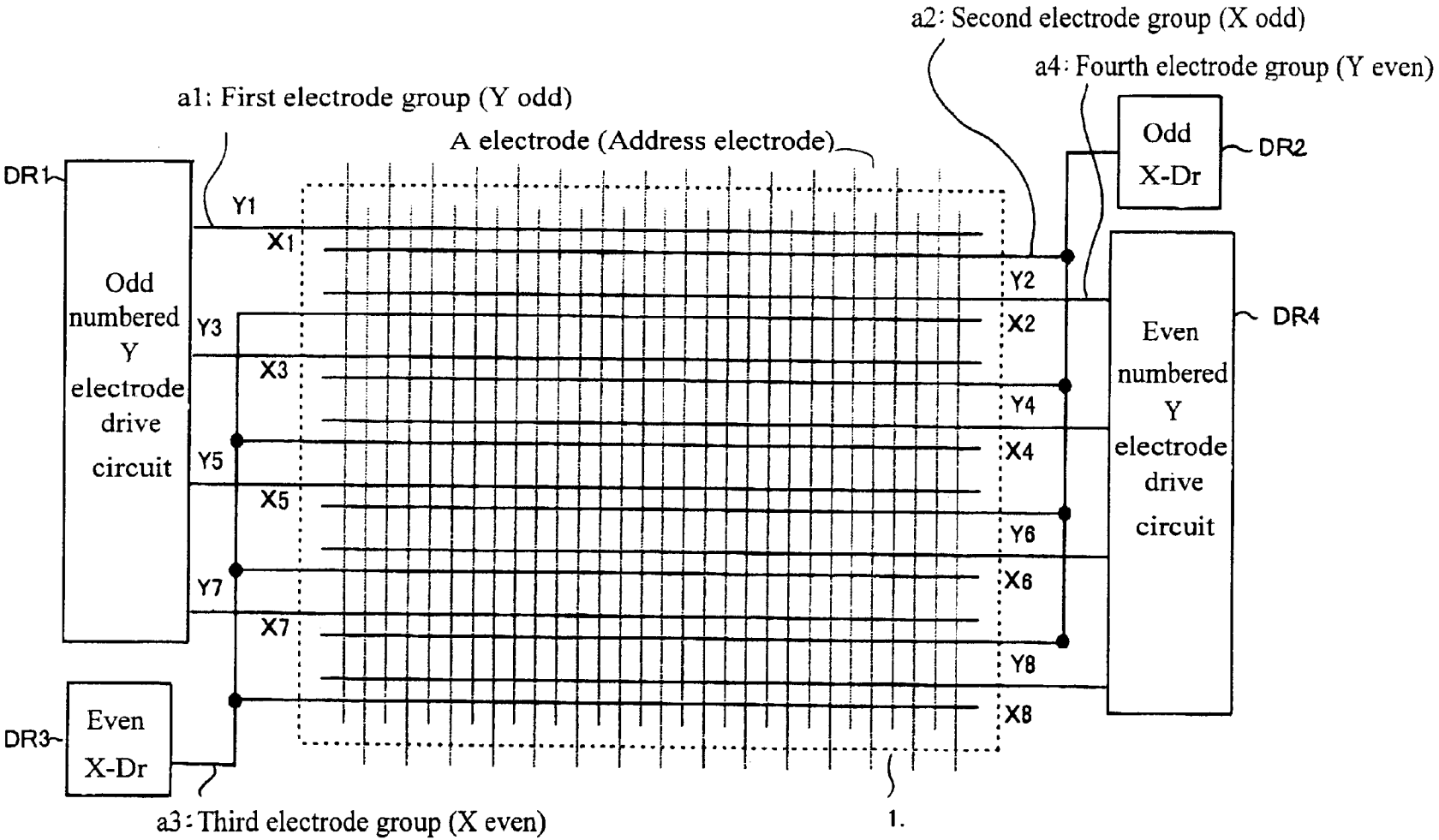
FIG. 8 is a diagram showing the relationship between the electrode groups and the drive circuits in the embodiment.

FIG. 8 is a diagram showing the relationship between the electrode groups and the drive circuits in the embodiment corresponding to the above combination (1). In this example, eight X electrodes and eight Y electrodes are provided in the PDP 1. Odd numbered Y electrodes Y1, Y3, Y5 and Y7 are assigned as the first electrode group a1, and even numbered Y electrodes Y2, Y4, Y6 and Y8 are assigned as the fourth electrode group a4. The odd numbered Y electrodes are driven by an odd numbered Y electrode drive circuit DR1, which is located on the left of the PDP 1. The odd numbered Y electrode drive circuit DR1 corresponds to the first drive circuit. The even numbered Y electrodes are driven by an even numbered Y electrode drive circuit DR4, which is located on the right of the PDP 1. The even numbered Y electrode drive circuit DR4 corresponds to the fourth drive circuit. Further, odd numbered X electrodes X1, X3, X5 and X7, which together with the odd numbered Y electrodes form display electrode pairs, are driven by the odd numbered X electrode drive circuit DR2, which is located on the right of the PDP 1. The odd numbered X electrode drive circuit DR2 corresponds to the second drive circuit. Even numbered X electrodes X2, X4, X6 and X8, which together with the even numbered Y electrodes form display electrode pairs, are driven by the even numbered X electrode drive circuit DR3, which is located on the left of the PDP 1. The even numbered X electrode drive circuit DR3 corresponds to the third drive circuit. The odd numbered X electrodes correspond to the second electrode group a2, and the even numbered X electrodes correspond to the third electrode group a3. The address electrodes A are perpendicularly arranged on the PDP 1.

Figure 9:
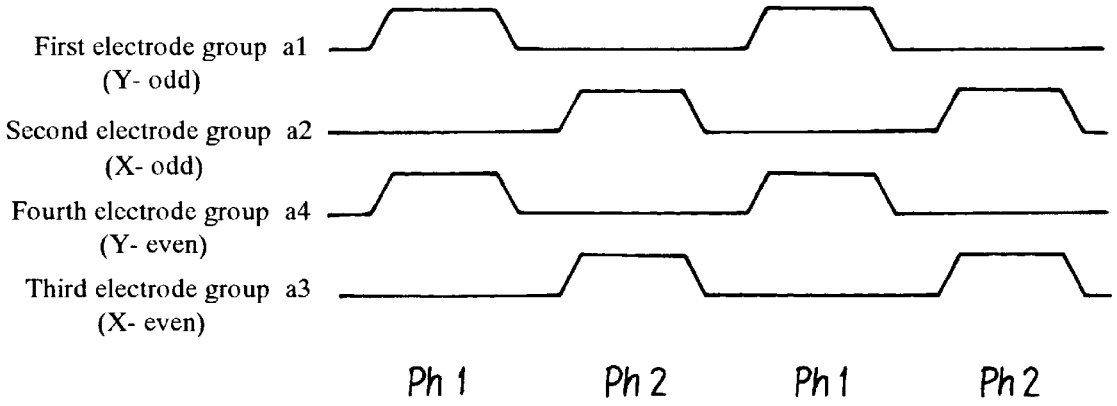
FIG. 9 is a timing chart of the plasma display device having the arrangement in FIG. 8 for applying a sustain discharge voltage.

FIG. 9 is a timing chart of the plasma display device having the arrangement in FIG. 8 for applying a sustain discharge voltage. During phase Ph1, the sustain discharge voltage is applied to the odd numbered Y electrodes a1 and the even numbered Y electrodes a4, and the odd numbered X electrodes a2 and the even numbered X electrodes a3 are grounded. As a result, the charge current from the odd numbered Y electrodes to the odd numbered X electrodes flows from the left to the right on the PDP1 in FIG. 8, and the charge current from the even numbered Y electrodes to the even numbered X electrodes flows from the right to the left on the PDP 1 in FIG. 8. In addition, the charge currents cancel each other out in the ground wiring connecting all the drive circuits. Furthermore, on the PDP 1, the vectors of the electromagnetic waves generated by the charge currents, which charge the capacitors located between the Y electrodes and the X electrodes, are oppositely aligned for the odd numbered electrode pairs and the even numbered electrode pairs. Therefore, the electromagnetic waves generated by adjacent electrode pairs spatially cancel each other out.

As is shown in FIG. 9, during phase Ph2, the sustain discharge voltage is applied to the odd numbered X electrodes a2 and the even numbered X electrodes a3, and the odd numbered Y electrodes a1 and the even numbered Y electrodes a4 are grounded. As a result, the charge current from the odd numbered X electrodes a2 to the odd numbered Y electrodes a1 flows from the right to the left on the PDP1 in FIG. 8, and the charge current from the even numbered X electrodes a3 to the even numbered Y electrodes a4 flows from the left to the right of the PDP 1 in FIG. 8. In addition, the charge currents cancel each other out on the ground wiring connecting all the drive circuits. Similarly, the electromagnetic waves generated by adjacent odd numbered display electrode pairs and even numbered electrode pairs spatially cancel each other out.

In the example in FIG. 9, of the eight Y electrodes and the eight X electrodes, the electrodes Y1, Y3, Y5 and Y7, and X1, X3, X5 and X7 are odd numbered electrodes, while the electrodes Y2, Y4, Y6 and Y8, and X2, X4, X6 and X8 are even numbered electrodes. However, Y1, Y2, Y5 and Y6, and X1, X2, X5 and X6 may, for example, be assigned in sets of two for odd numbered electrodes, and Y3, Y4, Y7 and Y8, and X3, X4, X7 and X8 may be assigned in sets of two for even numbered electrodes.

Figure 10:
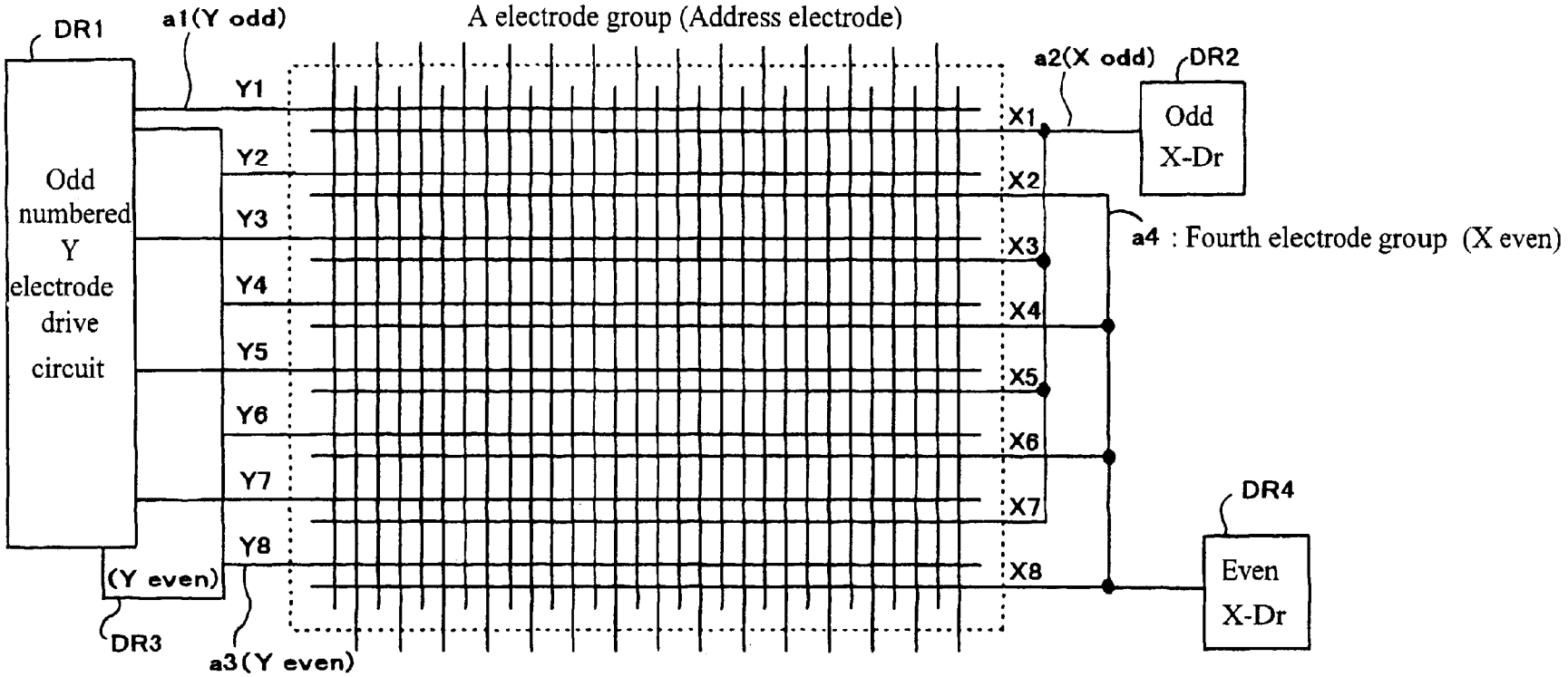
FIG. 10 is a diagram showing the relationship between the electrode groups and the drive circuits in the embodiment.

FIG. 10 is a diagram showing the relationship between the electrode groups and the drive circuits in the embodiment corresponding to the combination (2) previously described. Also in this example, eight X electrodes and eight Y electrodes, are provided in the PDP 1. Odd numbered Y electrodes Y1, Y3, Y5 and Y7 are assigned as the first electrode group a1, and even numbered Y electrodes Y2, Y4, Y6 and Y8 are assigned as the third electrode group a3. The odd numbered Y electrodes a1 are driven by an odd numbered Y electrode drive circuit DR1, which is located on the left of the PDP 1. The odd numbered Y electrode drive circuit DR1 corresponds to the first drive circuit. The even numbered Y electrodes a3 are driven by an even numbered Y electrode drive circuit DR3, which is also located on the left of the PDP 1. The even numbered Y electrode drive circuit DR3 corresponds to the third drive circuit. Further, odd numbered X electrodes X1, X3, X5 and X7, which together with the odd numbered Y electrodes form display electrode pairs, are driven by the odd numbered X electrode drive circuit DR2, which is located on the right of the PDP 1. The odd numbered X electrode drive circuit DR2 corresponds to the second drive circuit. Even numbered X electrodes X2, X4, X6 and X8, which together with the even numbered Y electrodes form display electrode pairs, are driven by the even numbered X electrode drive circuit DR4, which is also located on the right of the PDP 1. The even numbered X electrode drive circuit DR4 corresponds to the fourth drive circuit. The odd numbered X electrodes correspond to the second electrode group a2, and the even numbered X electrodes correspond to the fourth electrode group a4.

Figure 11:
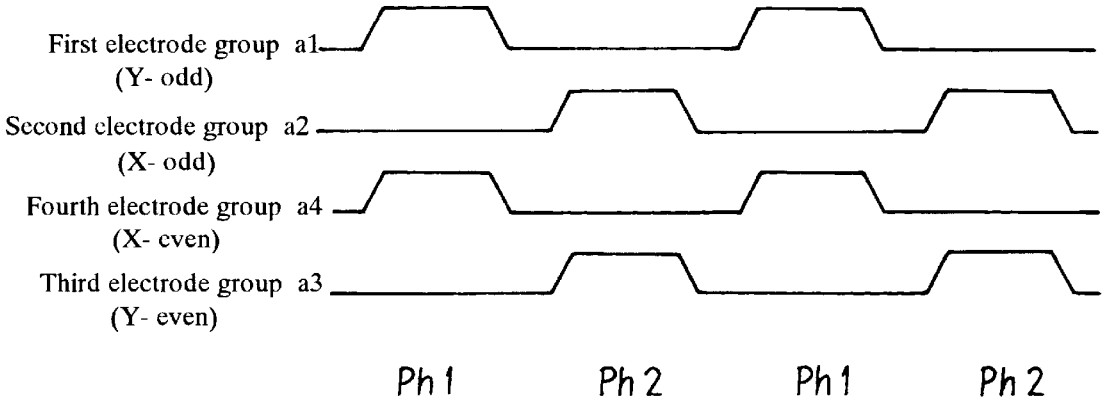
FIG. 11 is a timing chart for the plasma display device having the arrangement shown in FIG. 10 used for applying a sustain discharge voltage.

FIG. 11 is a timing chart for the plasma display device having the arrangement shown in FIG. 10 used for applying a sustain discharge voltage. Since in the arrangement in FIG. 10 both of the Y electrode drive circuits DR1 and DR 3 are located on the left of the PDP 1, during phase Ph1 their sustain discharge voltage pulses are applied to the odd numbered Y electrodes a1 and the even numbered X electrodes a4, and the odd numbered X electrodes a2 and the even numbered Y electrodes a3 are grounded, as is shown in FIG. 11. As a result, for the odd numbered electrode pairs the charge current flows from the left to the right of the PDP1 in FIG. 10, while for the even numbered electrode pairs the charge current flows from the right to the left of the PDP 1 in FIG. 10. In addition, the charge currents cancel each other out on the ground wiring connecting all the drive circuits.

During phase Ph2, on the contrary, the sustain discharge voltage is applied to the odd numbered X electrodes a2 and the even numbered Y electrodes a3, and the odd numbered Y electrodes a1 and the even numbered X electrodes a4 are grounded. As a result, for the odd numbered electrode pairs the charge current flows from the right to the left of the PDP1 in FIG. 10, while for the even numbered electrode pairs the charge current flows from the left to the right of the PDP 1 in FIG. 10.

In the plasma display device having the arrangement in FIG. 10, the sustain discharge pulse is not simultaneously applied to all the Y electrodes, but rather for the odd numbered display pairs the sustain discharge voltage is applied first to the Y electrodes, while for the even numbered electrode pairs it is applied first to the X electrodes. Therefore, an adequate address voltage application method used for the address period should be selected in accordance with the above application of the sustain discharge pulse. Further, by canceling the application of the sustain discharge pulse to the first even numbered X electrode and to the last odd numbered X electrode during the sustain discharge period, the sustain discharge from the Y electrodes to the X electrodes can always be performed first during the sustain discharge period.

Figure 12:
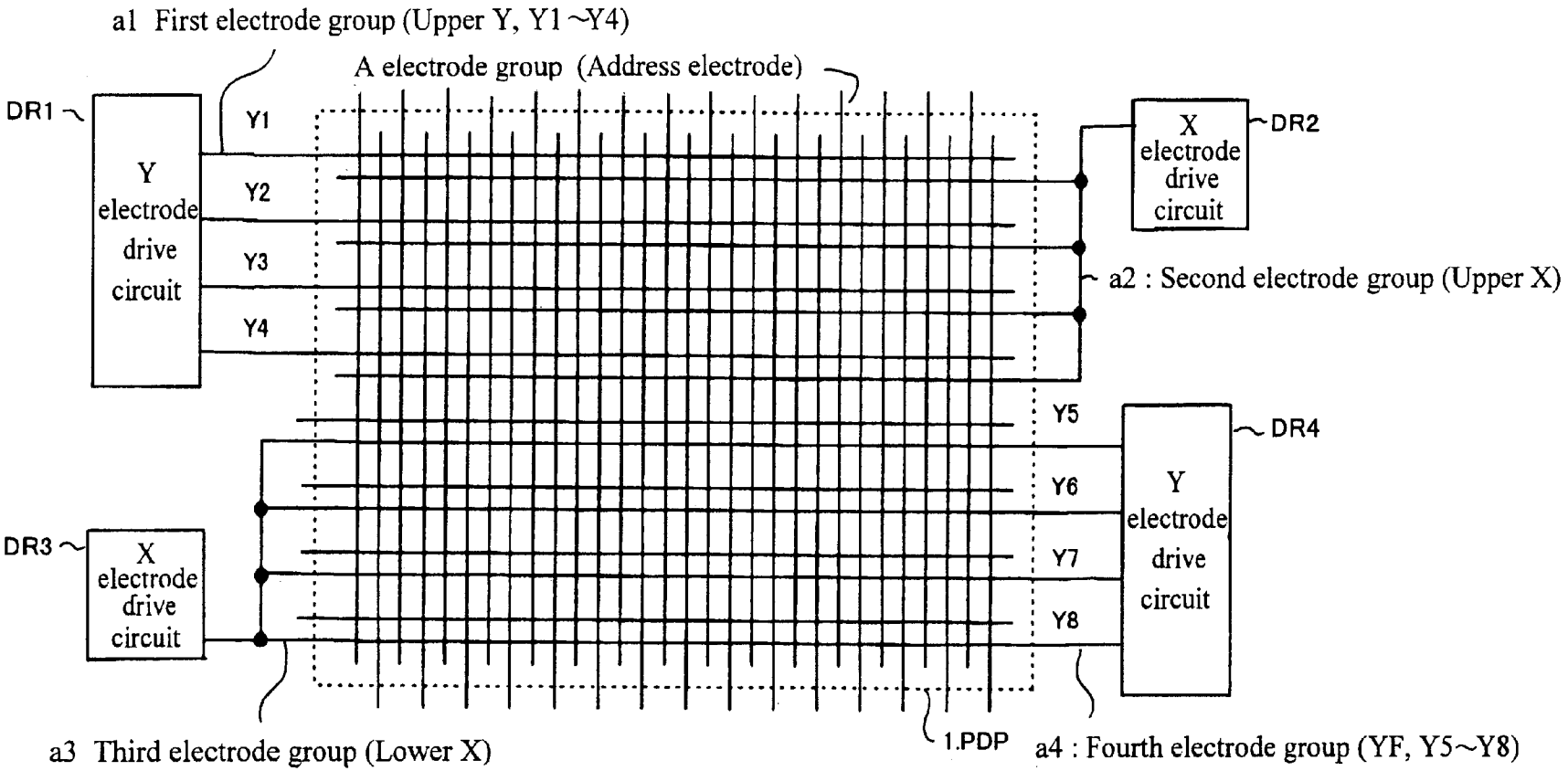
FIG. 12 is a diagram showing the relationship between the electrode groups and the drive circuits in the embodiment.

FIG. 12 is a diagram showing the relationship between the electrode groups and the drive circuits in the embodiment corresponding to the combination (3). In this example, the display electrode pairs are divided into those in the upper half portion (first region) of the PDP 1 and those in the lower half portion (second region). The upper Y electrodes correspond to the first electrode group a1, the upper X electrodes correspond to the second electrode group a2, the lower Y electrodes correspond to the fourth electrode group a4, and the lower X electrodes correspond to the third electrode group a3. The upper Y electrode group a1 is driven by the Y electrode drive circuit DR1 provided on the left of the PDP 1, and the upper X electrode group a2 is driven by the X electrode drive circuit DR2 provided on the right of the PDP 1. The lower Y electrode group a4 is driven by the Y electrode drive circuit DR4 provided on the right of the PDP 1, and the lower X electrode group a3 is by the X electrode drive circuit DR3 provided on the left of the PDP 1.

With the arrangement in FIG. 12, as well as that in FIG. 8, the sustain discharge pulse is applied to the electrode groups a1, a2, a3 and a4, as is shown in FIG. 9, and during phases Ph1 and Ph2, charge currents for a sustain discharge of the display electrode pairs flow in opposite directions across the upper region and the lower region. Therefore, the charge currents cancel each other out along the ground wiring connecting the drive circuits.

Figure 13:
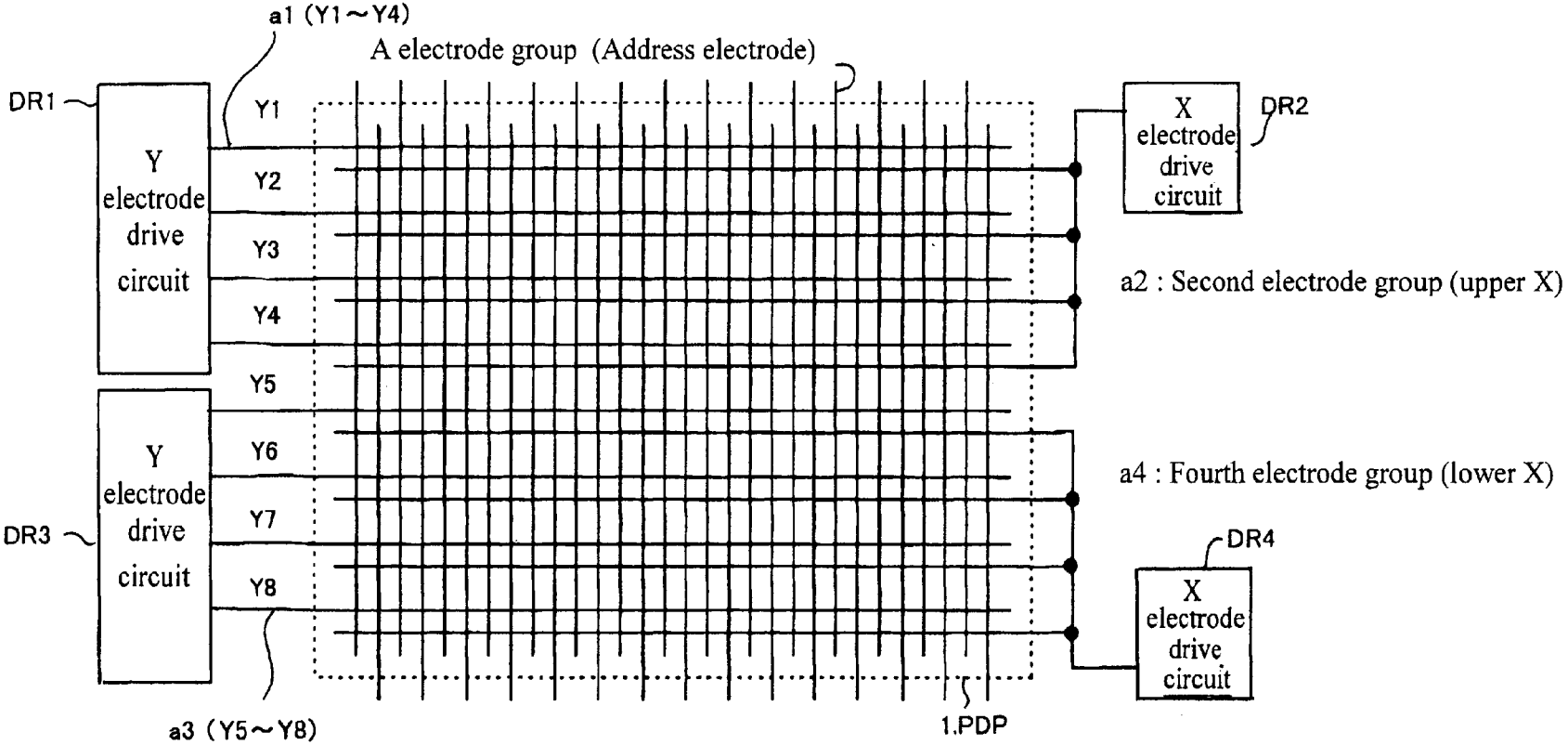
FIG. 13 is a diagram showing the relationship between the electrode groups and the drive circuits in the embodiment.

FIG. 13 is a diagram showing the relationship between the electrode groups and the drive circuits in the embodiment corresponding to the combination (4). Also in this example, the display electrode pairs are divided into those in the upper half portion (first region) of the PDP 1 and the lower half portion (second region). The upper Y electrodes correspond to the first electrode group a1, the upper X electrodes correspond to the second electrode group a2, the lower Y electrodes correspond to the third electrode group a3, and the lower X electrodes correspond to the fourth electrode group a4. The upper Y electrode group a1 is driven by the Y electrode drive circuit DR1 provided on the left of the PDP 1, and the upper X electrode group a2 is driven by the X electrode drive circuit DR2 provided on the right of the PDP 1. The lower Y electrode group a3 is driven by the Y electrode drive circuit DR3 provided on the left of the PDP 1, and the lower X electrode group a4 is driven by the X electrode drive circuit DR4 provided on the right of the PDP 1.

With the arrangement in FIG. 13, as well as that in FIG. 10, the sustain discharge pulse is applied to the electrode groups a1, a2, a3 and a4 as is shown in FIG. 11, and during phases Ph1 and Ph2, charge currents for a sustain discharge of the display electrode pairs flow in opposite directions across the upper region and the lower region. Therefore, the charge currents cancel each other out along the ground wiring connecting the drive circuits.

There may be other methods for classing the Y electrode gropes and the X electrode groups. So long as the charge currents between the first display electrode group and the second display electrode group flow in opposite directions upon the application of the sustain discharge pulse, the cancellation of the current along the common ground wiring and the spatial cancellation of electromagnetic waves on the PDP 1 can be implemented.

Figure 14:
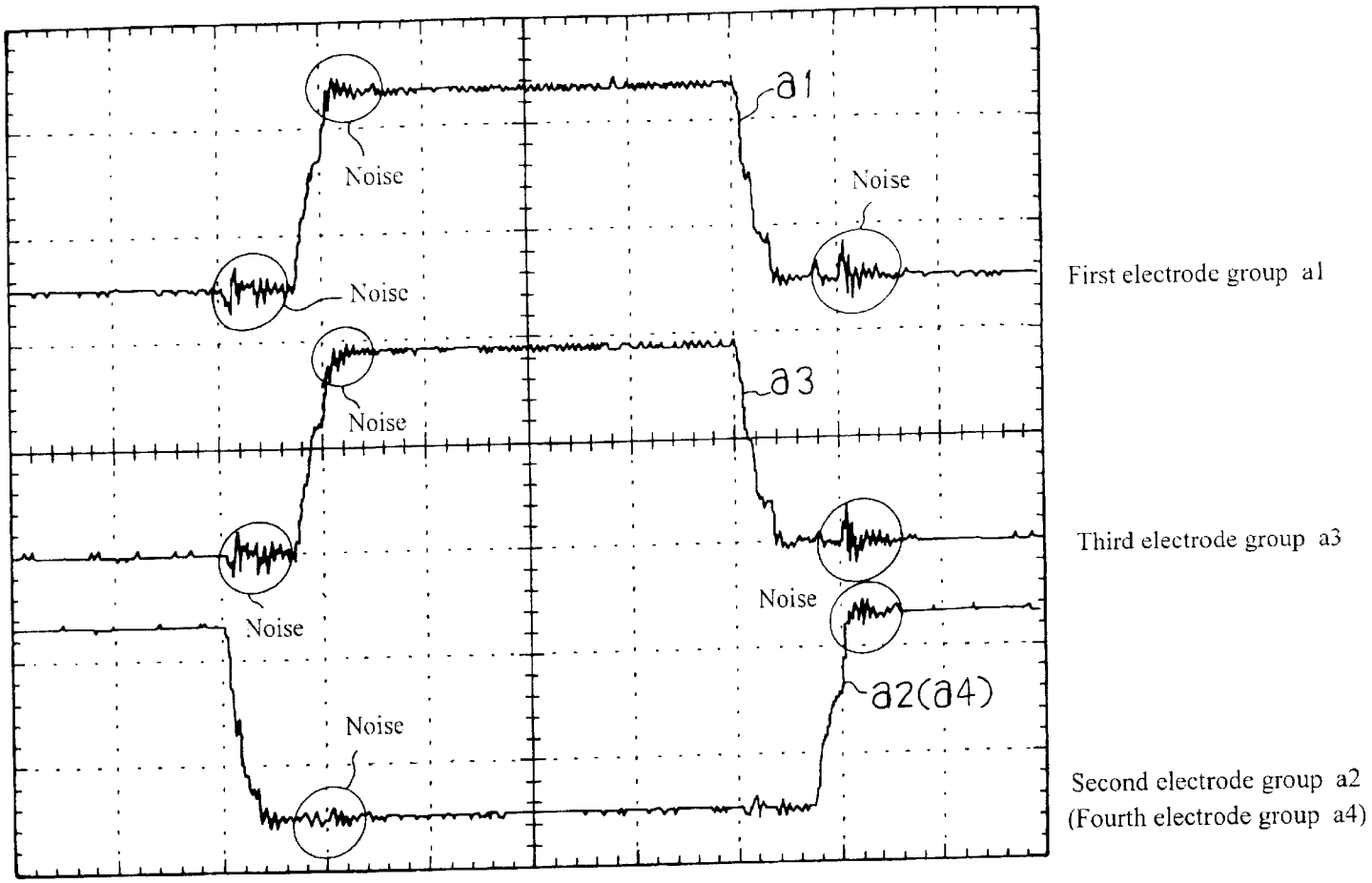
FIG. 14 is a graph showing waveforms of sustain discharge pulses to be applied to the first to the fourth electrode groups in a conventional case where the charge currents flow in the same direction upon the application of a sustain discharge pulse.

FIG. 14 is a graph showing waveforms of sustain discharge pulses to be applied to the first to the fourth electrode groups in a conventional case where the charge currents flow in the same direction upon the application of a sustain discharge pulse. Although the waveform of the sustain discharge pulse for the fourth electrode group is not shown because of the size of the sheet of paper, it is the same as that for the second electrode group. As is apparent form the pulse waveforms in FIG. 14, noise caused by parasitic inductances along the electrode wiring and the ground wiring are superimposed in the vicinities of the leading edges and the tailing edges of the pulses (portions indicated by circuits in FIG. 14). For example, noise concerning at level L, which is the ground potential, is caused by inductance along the ground wiring connecting the drive circuits.

Figure 15:
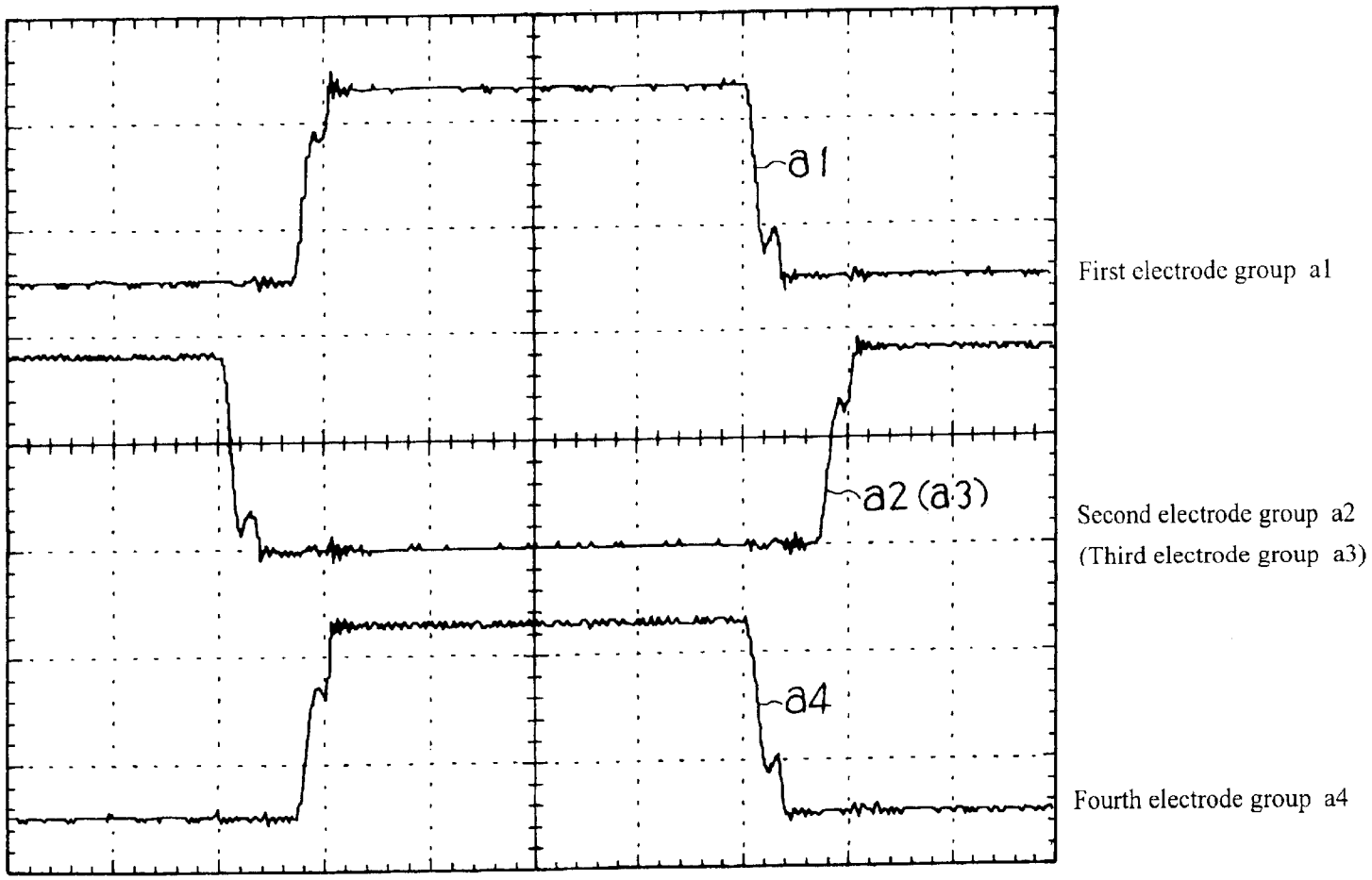
FIG. 15 is a graph showing the waveforms of sustain discharge pulses to be applied to the first to the fourth electrode groups in this embodiment of the present invention.

FIG. 15 is a graph showing the waveforms of sustain discharge pulses to be applied to the first to the fourth electrode groups in this embodiment of the present invention shown in FIG. 8. Compared with the graph in FIG. 14, it is found that the noise caused by inductances is reduced.

Figure 16:
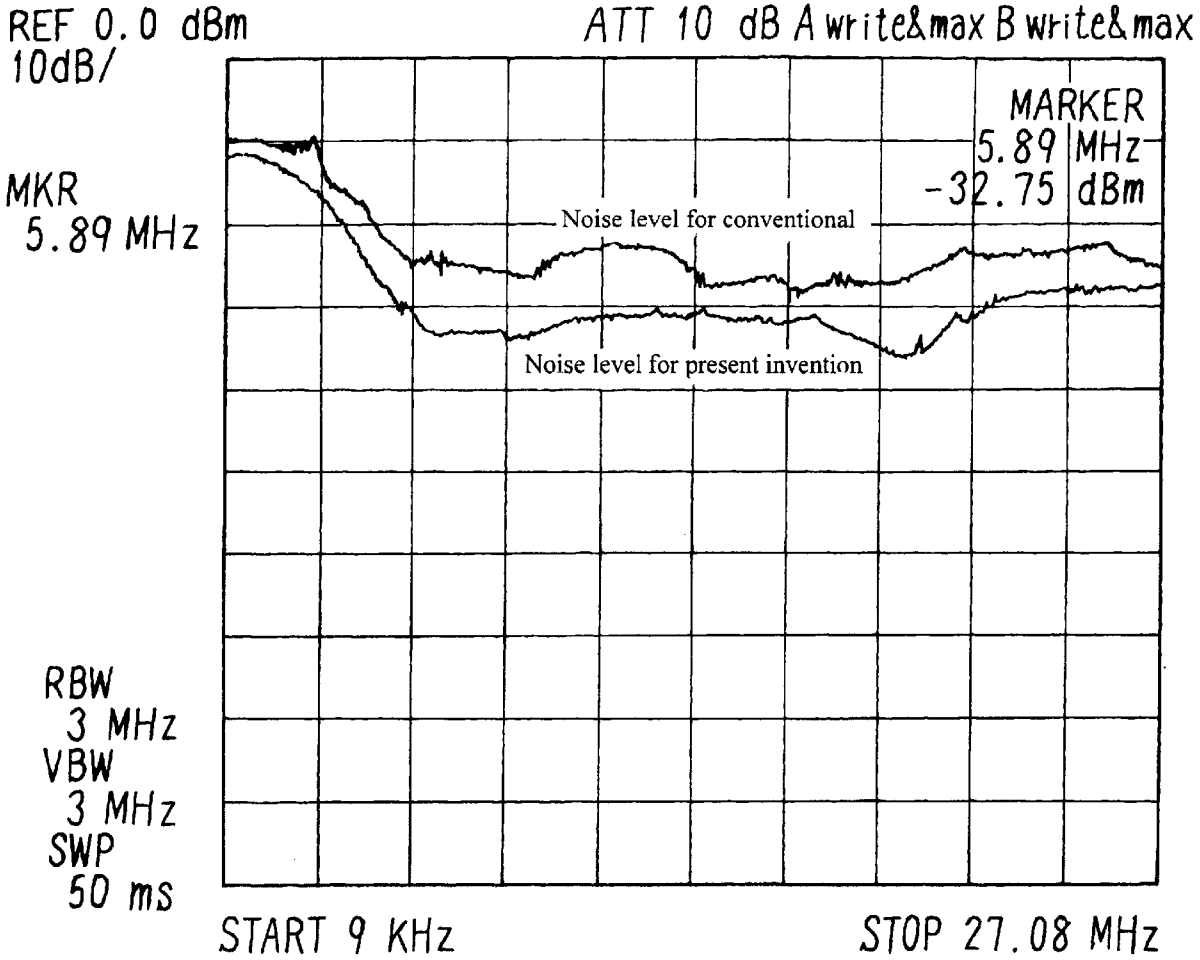
FIG. 16 is a graph showing the frequency spectra at the electromagnetic wave level (dB) for the conventional PDP and the embodiment of the present and the prior art.

FIG. 16 is a graph showing the frequency spectra at the electromagnetic wave level (dB) for the conventional PDP and the embodiment of the present invention. The graph shows the magnitude of the electromagnetic wave at each frequency relative to reference level 0, and as the level along the vertical axis is low, the noise level is also low. As is apparent from FIG. 16, the noise level of the present invention is about 10 dB lower than the noise level of the conventional PDP at the frequency band in the center of the graph.

Although in the above embodiment an explanation has been given for the charge current applied upon the application of the sustain discharge voltage, the present invention is not limited to this.

Another Embodiment

A plasma display device in which the density of electrodes for connecting drive circuits to a display panel can be reduced will now be described as another embodiment of the present invention. In the conventional plasma display device in FIG. 20, the printed circuit board on which a Y electrode drive circuit is mounted is provided on one side of the panel 1, and a printed circuit board on which an X electrode drive circuit is mounted is provided on the other side. Connection electrodes on the printed circuit boards and connection electrodes on the panel 1 are connected by a flexible cable (connection wiring group).

Figure 20:
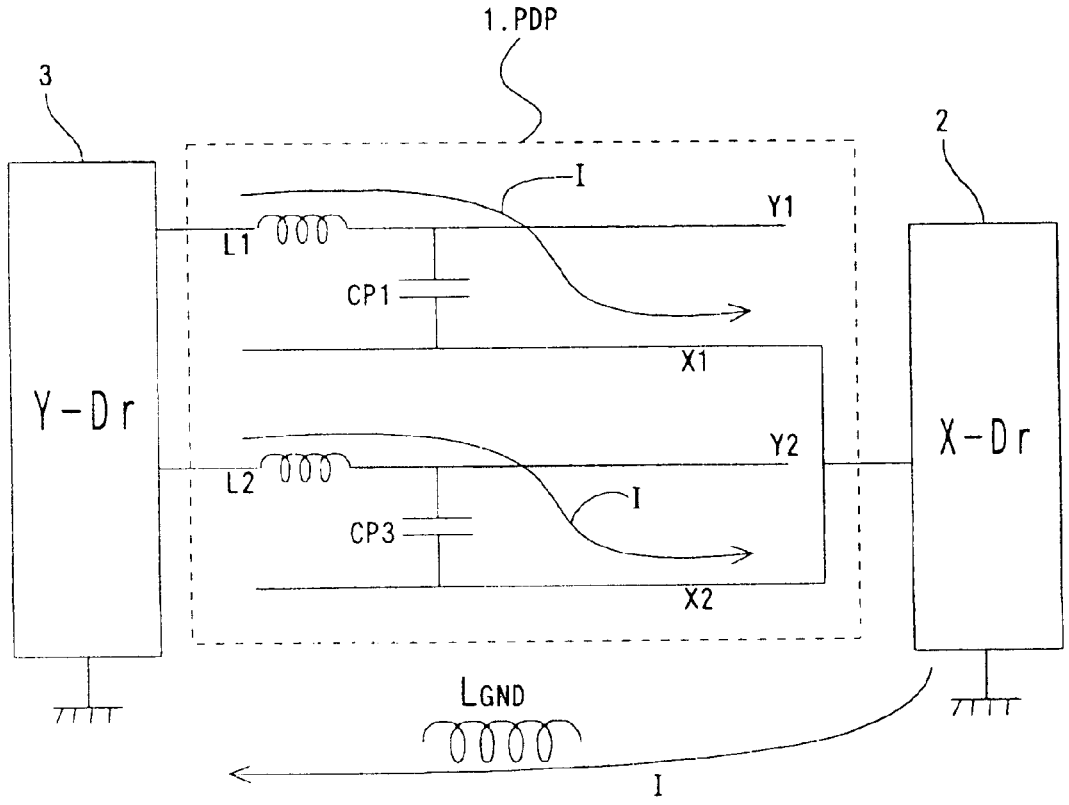
FIG.20 PRIOR ART
FIG. 20 is the conventional plasma display device in the prior art.
Figure 21:
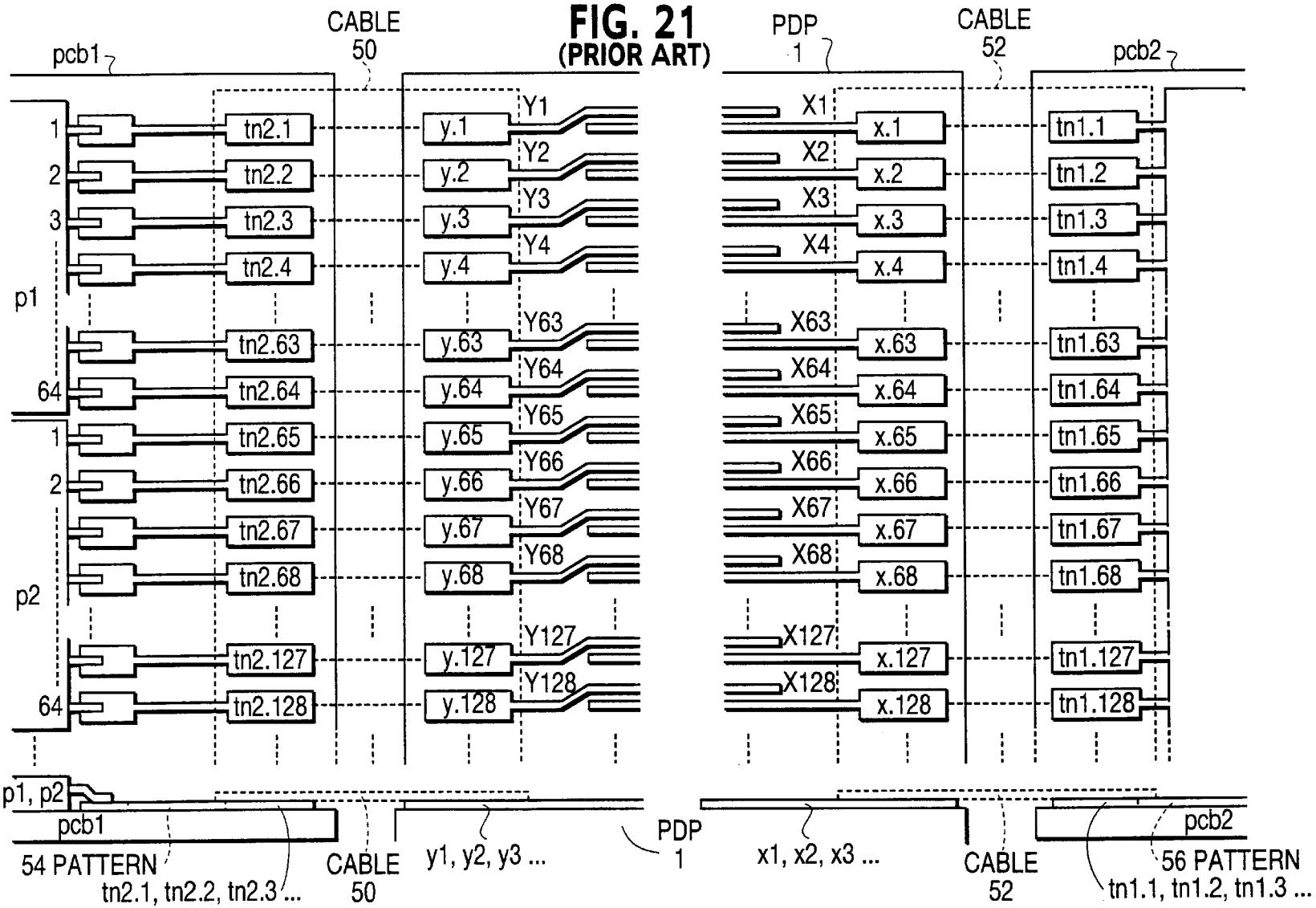
FIG. 21 (PRIOR ART)
FIG. 21 is a diagram showing connection portions between the drive circuit boards pcb1 and pcb2 and the display panel 1 in the prior art.

FIG. 21 is a diagram showing connection portions between the drive circuit boards pcb1 and pcb2 and the display panel 1 in the prior art shown in FIG. 20. The upper portion in FIG. 21 shows plan views and the lower portion shows corresponding cross-sectional views. The partially simplified plasma display panel 1 is shown in the center in FIG. 21. The Y electrodes and X electrodes of the display electrode pairs are shown. The Y electrodes are respectively connected to connection electrodes y1 to y128, which are formed along the left side of the panel 1. The X electrodes are connected to connection electrodes x1 to x128, which are formed along the right side of the panel 1. The Y electrode drive circuit is mounted on a printed circuit board pcb1, and has integrated circuits p1 and p2, each of which has 64 output terminals for driving 64 Y electrodes. These output terminals are connected to connection electrodes tn2.1 to tn2.128, which are formed along the right side of the printed circuit board pcb1. The connection electrodes y1 to y128 are connected to the connection electrodes tn2.1 to tn2.128 by cables 50.

Similarly, the X electrodes X1 to X128 are connected to the connection electrodes x1 to x128 formed along the right side of the panel 1, and the connection electrodes x1 to x128 are connected by cables 52 to connection electrodes tn1.1 to tn1.128 on a printed circuit board pcb2. The X electrode drive circuit is mounted on the printed circuit board pcb2.

Since while in the address period a scan pulse must be applied to the Y electrodes of the display electrode pairs, the Y drive circuits are independently driven. As is shown in the prior art in FIG. 21, the integrated circuits p1 and p2 have 64 output terminals. These output terminals are connected to the Y electrodes to drive them independently.

As the density of the Y electrodes tends to be increased in accordance with the increase in the size of the plasma display device and its more detailed fabrication, the density in the vicinity of the connection electrodes for connecting the Y electrode drive circuits and Y electrodes also tends to be increased. As a result, the arrangement of the drive circuits and the Y electrodes shown in FIG. 21 is unable to cope with a highly integrated assembly.

Figure 17:
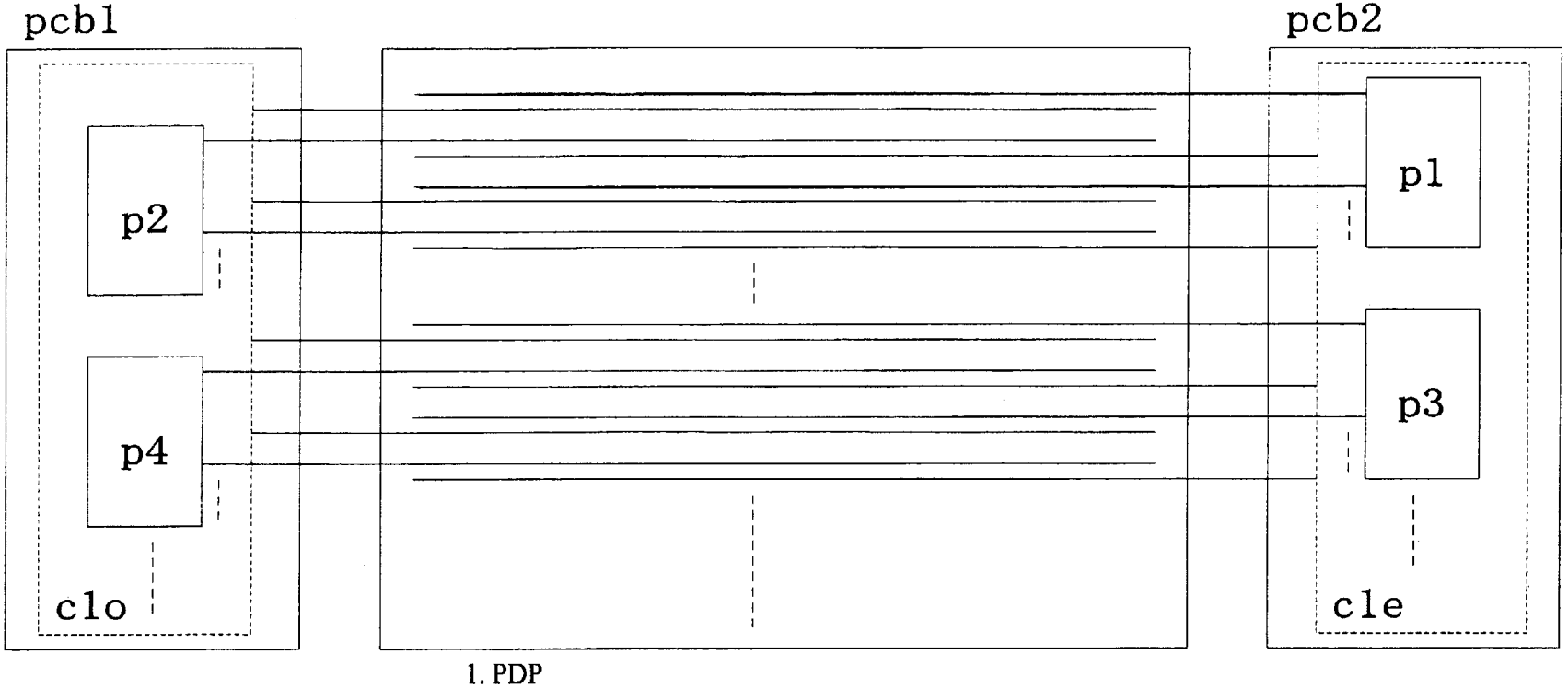
FIG. 17 is a schematic diagram illustrating the connection arrangement of the display electrode pairs and their drive circuits on the panel 1 according to this embodiment of the present invention.

FIG. 17 is a schematic diagram illustrating the connection arrangement of the display electrode pairs and their drive circuits on the panel 1 according to this embodiment of the present invention. While this arrangement is similar to that for the embodiment shown in FIG. 8, the locations of the drive circuits are inverted. Specifically, the odd numbered Y electrodes Y1 and Y3 to Y131 are respectively driven by drive circuits p1 and p3, which are mounted on the printed circuit board pcb2 on the right side of the panel 1. The odd numbered X electrodes X1 and X3 to X131 are driven by a drive circuit device c1o, which is mounted on the printed circuit board pcb1 on the left side of the panel 1.

The even numbered Y electrodes Y2 and Y4 to Y132 are respectively driven by drive circuits p2 and p4, which are mounted on the printed circuit board pcb1 on the left side of the panel 1. The even numbered X electrodes X2 and X4 to X132 are driven by a drive circuit device c1e, which is mounted on the printed circuit board pcb2 on the right side of the panel 1.

With this structure, the drive circuits for Y electrodes, which must be independently driven, can be provided on both sides of the panel 1. As a result, the density of the Y electrode connection electrodes, which are formed along one side, can be reduced. Accordingly, the density of the wiring pattern on the printed circuit board for connecting the connection electrodes to PDP1 and the output terminals of the drive circuits p1 p4 can be reduced. Furthermore, since the X electrode connection electrodes, to which a common drive circuit is connected, can be connected through a viahole to a drive circuit device c1o, c1e, the wiring pattern on the printed circuit board for connecting the Y connection electrodes to PDP1 and the output terminals of the drive circuits p1 p4 can be laid out in a larger area. Therefore, the formation of connection patterns is possible for a higher density display device.

Figure 18:
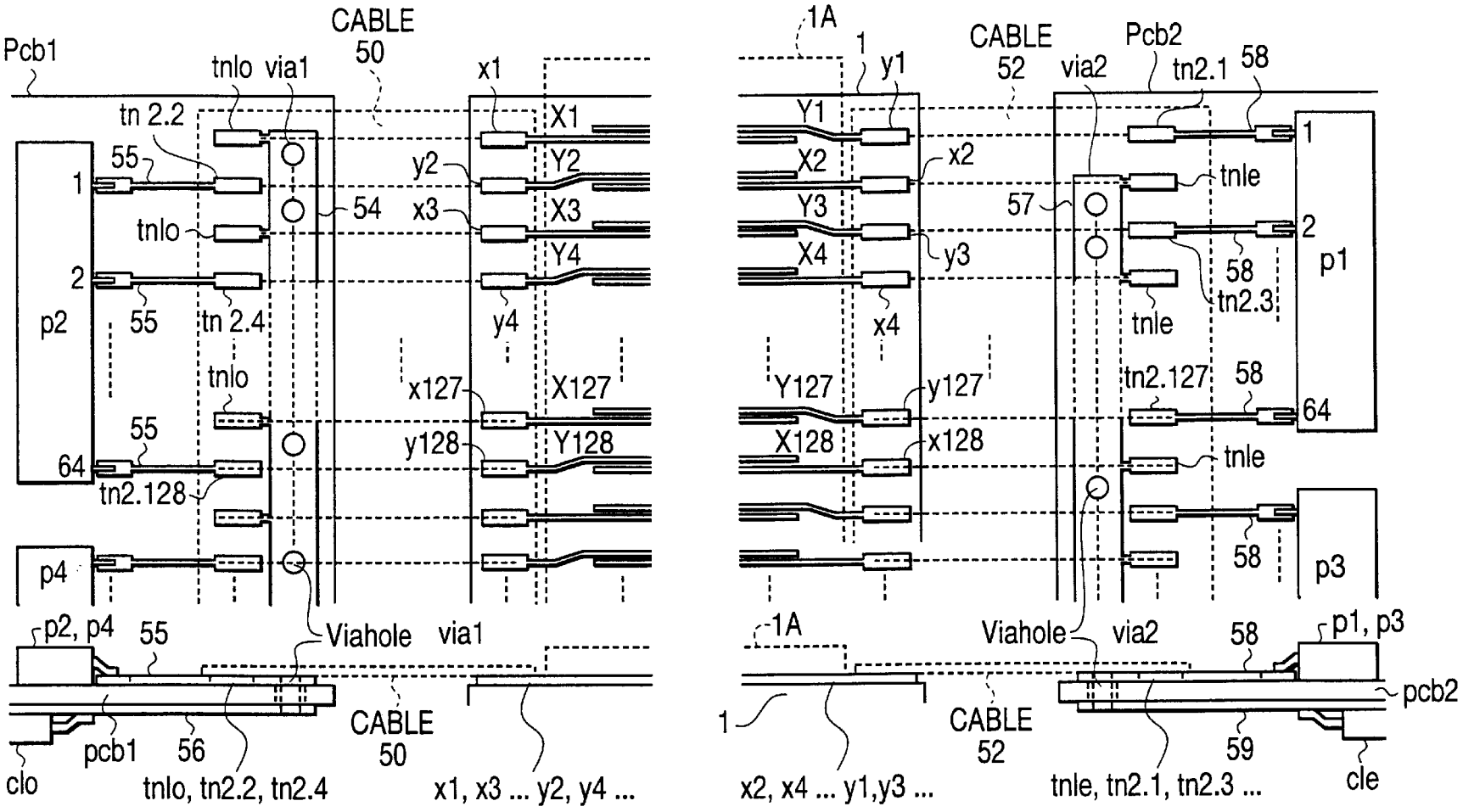
FIG. 18 is a partial plan view of a connection pattern in a specific connection region in FIG. 17.

FIG. 18 is a partial plan view of a connection pattern in a specific connection region in FIG. 17. In the lower portion in FIG. 18, as well as in FIG. 21, are shown cross sectional views corresponding to the plan views. As was explained while referring to FIG. 17, the odd numbered Y electrodes Y1 to Y127 are connected to the connection electrodes y1 to y127 provided along the right side of the panel 1, while the even numbered X electrodes X2 to X128 are also connected to the connection electrodes x2 to x128, which are also provided along the right side of the panel 1. The drive circuits p1 and p3 for driving the odd numbered Y electrodes are mounted on the printed circuit board pcb2, and the drive circuit c1e for driving the even numbered X electrodes is mounted on the rear face of the printed circuit board pcb2. The drive circuits p1 and p3 for driving the odd numbered Y electrodes each have 64 output terminals, and are connected via wiring patterns 58 to the connection electrodes tn2.1 to tn2.127, which are arranged along the left side of the printed circuit board pcb2. Connection electrodes tn1e for even numbered X electrodes are provided between the connection electrodes tn2.1 to tn2.127 for the odd numbered Y electrodes.

The electrodes tn1e for the connection of the odd numbered X electrodes are connected via a common wiring pattern 57, a viahole via2 and a common wiring pattern 59 on the rear face of the printed circuit board pcb2 to the output terminals of the drive circuit c1e which is also mounted on the rear face of the printed circuit board pcb2. In addition, since the intervals between the connection electrodes tn2.1 to tn2.127 and tn1e are very short, the viahole via2 is formed under the common wiring pattern 57.

The connection electrodes y1, x1, on the panel 1 are connected to the connection electrodes on the printed circuit board pcb2 by connection cables 52, which are formed on a flexible insulating board. In FIG. 18, reference numeral 1A denotes a glass substrate opposite the panel 1.

As is described above, for the Y electrodes which must be driven independently, the connection electrodes tn2.1 to tn2.127 for even numbered Y electrodes, one half the total electrodes, are formed on the printed circuit board pcb2. These connection electrodes can be so arranged that they match the pitches of the 64 output terminals protruding from each of the drive circuits p1 and p3. Furthermore, since the drive circuit for the even numbered X electrodes is mounted on the rear face of the printed circuit board pcb2, the wiring pattern 58 for the connection of the Y electrodes can be formed with an adequate margin on the surface of the print board pcb2. In addition, since the viahole via2 extending from the rear face to the front face is not formed along the row of the connection electrodes tn1e, tn2.1 but along the common wiring pattern 57, a lot of space is available for the formation of the connection electrodes tn1e, tn2.1 . . . .

The left side in FIG. 18 has the same arrangement as that described above. Specifically, the even numbered Y electrodes Y2 to Y128 are connected to the connection electrodes y2 to y128 provided along the left side of the panel 1, while the odd numbered X electrodes X1 to X127 are also connected to the connection electrodes x1 to x127 which are also provided along the left side of the panel 1. The drive circuits p2 and p4, for driving the even numbered Y electrodes, are mounted on the printed circuit board pcb1, and the drive circuit c1o for driving the odd numbered X electrodes is mounted on the rear face of the printed circuit board pcb1. The drive circuits p2 and p4, for driving the even numbered Y electrodes, each have 64 output terminals, and are connected via wiring pattern 55 to the connection electrodes tn2.2 to tn2.128, which are arranged along the left side of the printed circuit board pcb1. Connection electrodes tn1o, for odd numbered X electrodes, are provided between the connection electrodes tn2.2 to tn2.128 for the even numbered Y electrodes.

The electrodes tn1o for the connection of the odd numbered X electrodes are connected via a common wiring pattern 54, a viahole vial and a common wiring pattern 56 on the rear face of the printed circuit board pcb1 to the output terminal of the drive circuit c1o which is also mounted on the rear face of the printed circuit board pcb1. In addition, since the intervals between the connection electrodes tn2.2 to tn2.128 and tn1o are very short, the viahole via1 is formed under the common wiring pattern 54. The connection electrodes x1, y2, on the panel 1 are connected to the connection electrodes tn1o, tn2.2 on the printed circuit board pcb1 by connection cables 50, which are formed on a flexible insulating board.

Figure 19:
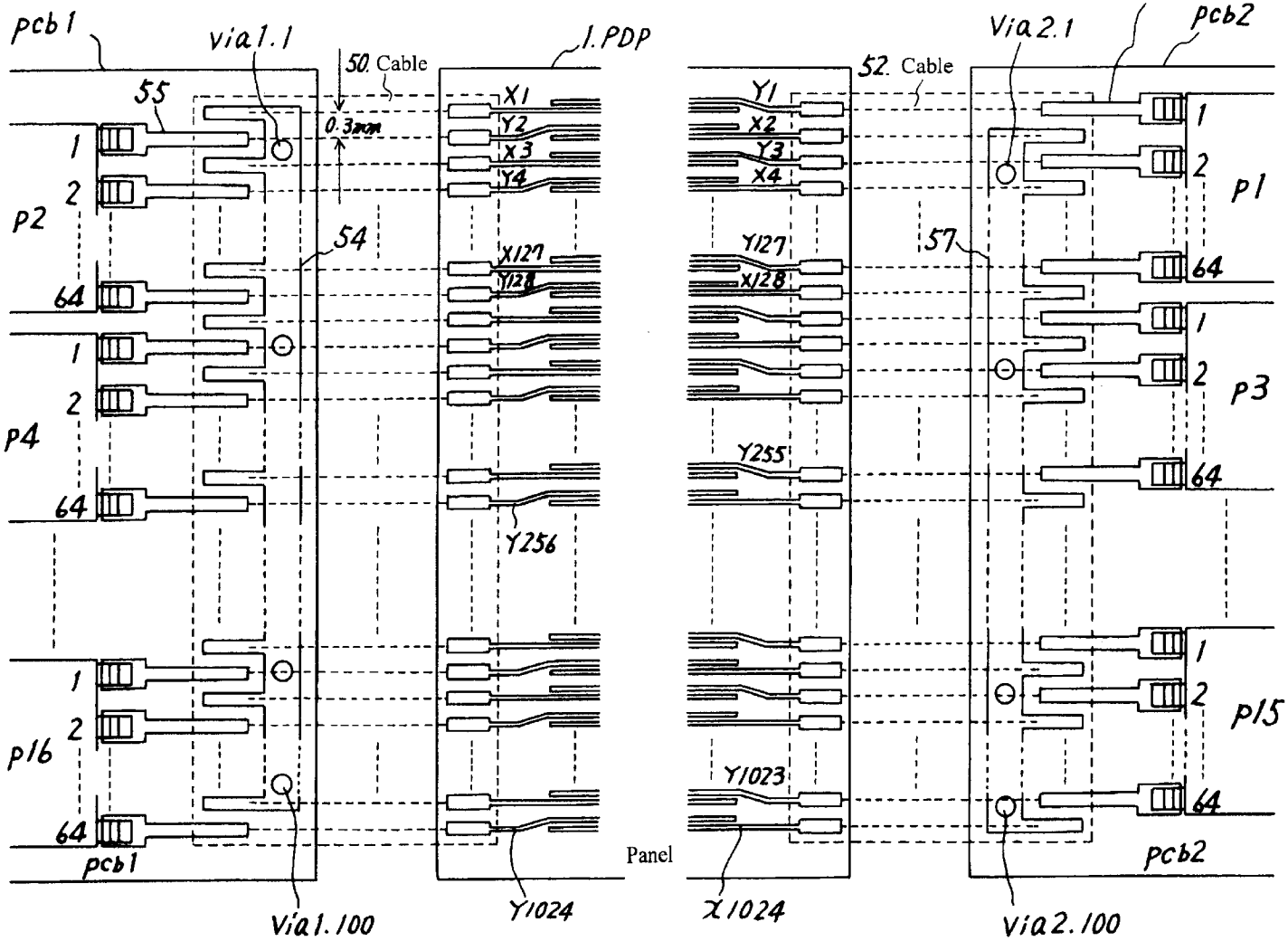
FIG. 19 is a plan view of the entire plasma display device.

FIG. 19 is a plan view of the entire plasma display device. The arrangement in FIG. 18 is applied to a plasma display device having 1024 Y electrodes. The detailed connection electrodes and wiring patterns are the same as those in FIG. 18. Y electrode drive circuits p2 and p4 to p16, each having 64 output terminals, are provided on the printed circuit board pcb1, and the same structured Y electrode drive circuits p1 and p3 to p15 are provided on the printed circuit board pcb2. Viaholes via1.1 to via1.100 are formed in the common wiring pattern 54, and viaholes via2.1 to via2.100 are formed in the common pattern wiring 57. As is apparent from FIG. 19, a low density arrangement can be provided for the wiring patterns 55 and 58 positioned between the Y electrode drive circuits p1 p16 and their connection electrodes, and a sufficiently large space is available.

The number of viaholes via is determined based on the following premise. Supposing that a permissible current flowing through one viahole is defined as $I_{VH}$; the maximum current flowing to one X electrode is defined as $I_{X1}$; the maximum current flowing across the drive circuit c1o (total current for odd numbered X electrodes) is defined as $I_{c1o}$; the maximum current flowing across the drive circuit c1e (the total current for even numbered X electrodes) is defined as $I_{c1e}$; the number of odd numbered X electrodes is defined as $N_{Xo}$; and the number of even numbered X electrodes is defined as $N_{Xe}$, then the number of viaholes $N_{VH1}$ in the printed circuit board pcb1 can be determined by $$\left[\frac{I_{clo}}{I_{VH}}\right]+1 \le N_{VH1} < \left(\left[\frac{I_{X1}}{I_{VH}}\right]+1\right)\cdot N_{Xo} \tag{1}$$

In the above expression (1), the number $N_{VH1}$ of viaholes is equal to or greater than a value obtained by adding an extra one to the quotient provided by the division of the maximum current $I_{c1o}$, which flows across the drive circuit c1o, by the permissible current $I_{VH}$ for one viahole, and less than a greatest value which is obtained by multiplying the number of X electrodes $N_{Xo}$ and a result obtained by adding an extra one to the quotient provided by the division of the maximum current $I_{X1}$, which flows across one X electrode, by the permissible current $I_{VH}$ for one viahole. Therefore, the number of viaholes which satisfies the above expression (1) is adequate without providing too much or less than necessary. When the number of viaholes formed is not equal to or greater than the value represented on the left side of expression (1), the viaholes generate heat, which causes connectivity disruptions or shortcircuits. And the formation of the viaholes in a number exceeding the value represented in the right side is wasteful.

Likewise, the number of viaholes $N_{VH2}$ has been provided for the printed circuit board pcb2 when the following expression is true.

$$\left[\frac{I_{cle}}{I_{VH}}\right]+1 \le N_{VH2} < \left(\left[\frac{I_{X1}}{I_{VH}}\right]+1\right)\cdot N_{Xe} \tag{2}$$

In this embodiment, N electrodes for the connection of the Y electrodes are located on both sides of the panel 1, as two sets of N/2 when N is an even number, or as a set of (N−1)/2 and (N+1)/2 when N is an odd number. And also, the Y electrode drive circuits p1 and p2 are located on either side of the panel 1. Therefore, when a single drive circuit has M output terminals, the arrangement density is represented as follows, compared with the density when, as is done conventionally, the conventional drive circuits are concentrated on only one side. The denominator of this expression is the conventional value, and the numerator is the value employed in this embodiment.

When N is an even number,

When N is an odd number, $$\frac{\left[\frac{N/2-1}{M}\right]+1}{\left[\frac{N-1}{M}\right]+1}\cdot\frac{\left[\frac{(N-1)/2-1}{M}\right]+1}{\left[\frac{N-1}{M}+1\right]},$$

or, $$\frac{\left[\frac{(N+1)/2-1}{M}\right]+1}{\left[\frac{N-1}{M}\right]+1}.$$

In other words, the density is reduced substantially by half.

In this embodiment of the present invention, the pitches of the connection electrodes on the printed circuit board do not differ very much from the prior art; however, the Y electrode connection electrodes tn2 and the X electrode connection electrodes tn1 are led to opposite sides directed away from each other. And therefore, the formation of the viaholes in the X electrode common pattern 54 does not affect the Y electrode connection electrodes tn2, while the output terminals of the drive circuits cp1 and cp2 can be connected to the connection electrodes tn2 via the patterns 55 and 58. Since the X electrode connection electrodes tn1o and tn1e are connected to the respective common wiring patterns 54 and 57, only to the minimum number of viaholes is required for their connection electrodes tn1o and tn1e to be connected to the drive circuits c1o and c1e. That is, the number of viaholes can be reduced.

As is described above, according to the present invention, in the plasma display device, the drive circuits for display electrode pairs are so arranged that a current generated by applying a drive voltage to the first display electrode pair flows in a direction opposite to the flow of a current generated by applying a drive voltage to the second display electrode pair. Therefore, electromagnetic waves, which are generated by currents which accompany a charge/discharge upon the application of a drive voltage, cancel each other out, and the currents, which accompany a charge/discharge occurring upon the application of a drive voltage to the first and the second display electrode pairs, cancel out along the common ground wiring. As a result, the propagation of external electromagnetic waves at the plasma display device can be inhibited.

In addition, according to the present invention, odd numbered Y electrode drive circuits and even numbered Y electrode drive circuits are separately arranged on circuit boards, on both sides of a plasma display panel, on which are mounted the drive circuits for driving the panel. Therefore, the density of the connection wiring between the Y electrode connection electrodes and the output terminals of the drive circuits can be reduced, and a very high density display device can be provided.

What is claimed is:

1. A plasma display device comprising:

a first insulating substrate on which a plurality of display electrode pairs are separately formed along display lines where plasma discharge for display is performed, said plural display electrode pairs including a plurality of first display electrode pairs and a plurality of second display electrodes pairs;

a second insulating substrate on which a plurality of address electrodes are formed so as to intersect said display electrode pairs, said first and said second insulating substrates being located opposite each other with an intervening discharge space therebetween;

a first drive circuit for applying a drive voltage to said first display electrode pairs; and a second drive circuit for applying a drive voltage to said second display electrode pairs, wherein a direction of a charge current flowing at said first display electrode pairs when said drive voltage is applied by said first drive circuit is opposite on said plasma display panel to a direction of a charge current flowing at said second display electrode pairs when said drive voltage is applied by said second drive circuit.

2. A plasma display device according to claim 1, wherein plasma discharge occurs only between display electrode pairs.

3. A plasma display device comprising:

a first insulating substrate on which a plurality of display electrode pairs are separately formed along display lines where plasma discharge for display is performed, said plural display electrode pairs including a plurality of first display electrode pairs, each of which has a first electrode and a second electrode parallel to said first electrode, and a plurality of second display electrode pairs, each of which has a third electrode and a fourth electrode parallel to said third electrode, said plurality of display electrode pairs alternately discharging plasma from one electrode to the other and vice versa, during a first period and a second period;

a second insulating substrate on which a plurality of address electrodes are formed so as to intersect said display electrode pairs, said first and said second insulating substrates being located opposite each other with an intervening discharge space therebetween;

a first drive circuit, provided at one side of said display electrode pairs of said plasma display panel, for applying a drive voltage to said first electrode during said first period;

a second drive circuit, provided at the other side of said display electrode pairs of said plasma display panel, for applying a drive voltage to said second electrode during said second period;

a third drive circuit, provided at one side of said display electrode pairs of said plasma display panel, for applying a drive voltage to said third electrode during said second period; and a fourth drive circuit, provided at the other side of said display electrode pairs of said plasma display panel, for applying a drive voltage to said fourth electrode during said first period.

4. A plasma display device according to claim 3, wherein said first display electrode pairs comprises odd numbered electrode pairs among said plurality of display electrode pairs, and said second electrode pairs comprises even numbered electrode pairs among said plurality of display electrode pairs.

5. A plasma display device according to claim 4, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

6. A plasma display device according to claim 3, wherein said display electrode pairs each have Y electrodes to be independently driven and X electrodes to be simultaneously driven; said first display electrode pairs comprise odd numbered electrode pairs among said plurality of display electrode pairs, and said second electrode pairs comprise even numbered electrode pairs among said plurality of display electrode pairs; and said first electrode comprises an odd numbered Y electrode, said second electrode comprises an odd numbered X electrode, said third electrode comprises an even numbered X electrode and said fourth electrode comprises an even numbered Y electrode.

7. A plasma display device according to claim 6, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

8. A plasma display device according to claim 3, wherein said display electrode pairs each have Y electrodes to be independently driven and X electrodes to be simultaneously driven; of said plurality of display electrode pairs, said first display electrode pairs comprise odd numbered electrode pairs among said plurality of display electrode pairs and said second electrode pairs comprise even numbered electrode pairs among said plurality of display electrode pairs; and said first electrode comprises an odd numbered Y electrode, said second electrode comprises an odd numbered X electrode, said third electrode comprises an even numbered Y electrode and said fourth electrode comprises an even numbered X electrode.

9. A plasma display device according to claim 8, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

10. A plasma display device according to claim 3, wherein said first display electrode pairs comprise electrode pairs formed in a first region of said plasma display panel, and said second display electrode pairs comprise electrode pairs formed in a second region which differs from said first region of said plasma display panel.

11. A plasma display device according to claim 10, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

12. A plasma display device according to claim 3, wherein said display electrode pairs have Y electrodes to be independently driven and X electrodes to be simultaneously driven; said first display electrode pairs comprise electrode pairs formed in a first region of said plasma display panel, and said second display electrode pairs comprise electrode pairs formed in a second region which differs from said first region of said plasma display panel; and said first and said fourth electrodes comprise Y electrodes, and said second and said third electrodes comprise X electrodes.

13. A plasma display device according to claim 12, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

14. A plasma display device according to claim 3, wherein said display electrode pairs have Y electrodes to be independently driven and X electrodes to be simultaneously driven; said first display electrode pairs comprise electrode pairs formed in a first region of said plasma display panel, and said second display electrode pairs comprise electrode pairs formed in a second region which differs from said first region of said plasma display panel; and said first and said third electrodes comprise Y electrodes, and said second and said fourth electrodes comprise X electrodes.

15. A plasma display device according to claim 14, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

16. A plasma display device according claim 3, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

17. A plasma display device according to claim 3, wherein plasma discharge occurs only between display electrode pairs.

18. A plasma display device comprising:

a first insulating substrate on which a plurality of display electrode pairs are separately formed along display lines where plasma discharge for display is performed, wherein each of said plural display electrode pairs includes Y electrode and X electrode, said display electrode pairs alternately discharging plasma from one electrode to the other electrode and vice versa, during a first period and a second period;

a second insulating substrate on which a plurality of address electrodes are formed so as to intersect said display electrode pairs, said first and said second insulating substrates being located opposite each other with an intervening discharge space therebetween;

a first drive circuit, provided at one side of said display electrode pairs of said plasma display panel, for applying a drive voltage to odd numbered Y electrodes during said first period;

a second drive circuit, provided at the other side of said display electrode pairs of said plasma display panel, for applying a drive voltage to odd numbered X electrodes during said second period;

a third drive circuit, provided at one side of said display electrode pairs of said plasma display panel, for applying a drive voltage to even numbered X electrodes during said second period; and a fourth drive circuit, provided at the other side of said display electrode pairs of said plasma display panel, for applying a drive voltage to even numbered Y electrodes during said first period.

19. A plasma display device according to claim 18, further comprising:

a first circuit board, provided at one end of said display electrode pairs of said plasma display panel, on which said first drive circuit and said third drive circuit are mounted, and for which a plurality of electrodes for connecting odd numbered Y electrodes are formed which are to be connected to the output terminals of said first drive circuit, and a plurality of electrodes for connecting even numbered X electrodes are arranged between said electrodes for connecting odd numbered Y electrodes;

a second circuit board, provided at the other end of said display electrode pairs of said plasma display panel, on which said second drive circuit and said fourth drive circuit are mounted, and for which a plurality of electrodes for connecting even numbered Y electrodes are formed which are to be connected to the output terminals of said second drive circuit, and a plurality of electrodes for connecting odd numbered X electrodes are arranged between said electrodes for connecting even numbered Y electrodes;

a first connection wiring group to connect said electrodes for connecting odd numbered Y electrodes and said electrodes for connecting even numbered X electrodes mounted on said first circuit board, to ends of odd numbered Y electrodes and even numbered X electrodes of said display electrode pairs of said plasma display panel; and a second connection wiring group to connect said electrodes for connecting even numbered Y electrodes and said electrodes for connecting odd numbered X electrodes mounted on said second circuit board, to ends of even numbered Y electrodes and odd numbered X electrodes of said display electrode pairs of said plasma display panel.

20. A plasma display device according to claim 19, wherein a common wiring pattern connected to said electrodes for connecting said even numbered X electrodes is located at the side opposite to said first drive circuit on said first circuit board, and said common wiring pattern and said output terminals of said third drive circuit are connected through a viahole provided in said first circuit board; and a common wiring pattern connected to said electrodes for connecting said odd numbered X electrodes is located at the side opposite to said fourth drive circuit on said second first circuit board, and said common wiring pattern and said output terminals of said second drive circuit are connected through a viahole provided in said second circuit board.

21. A plasma display device according to claim 20, wherein, when a permissible current flowing to one of the viahole is defined as $I_{VH}$, the maximum current flowing to one of said X electrodes is defined as $I_{x1}$, the maximum current flowing across said second drive circuit for said odd numbered X electrodes is defined as $I_{c1to}$, the maximum current flowing across said third drive circuit for said even numbered X electrodes is defined as $I_{c1e}$, the number of said odd numbered X electrodes is defined as $N_{Xo}$ and the number of said even numbered X electrodes is defined as $N_{Xe}$, the number $N_{VH1}$ of viaholes in said first circuit board is set to $$\left[\frac{I_{clo}}{I_{VH}}\right]+1 \le N_{VH1} < \left(\left[\frac{I_{Xl}}{I_{VH}}\right]+1\right)\cdot N_{Xo},$$

and the number $N_{VH2}$ of viaholes of said second circuit board is set to $$\left[\frac{I_{cle}}{I_{VH}}\right]+1 \le N_{VH2} < \left(\left[\frac{I_{Xl}}{I_{VH}}\right]+1\right)\cdot N_{Xe}.$$

22. A plasma display device according to claim 18, wherein said first through said fourth drive circuits each have a pull-up element for connecting said display electrode to a high power source when said drive voltage is to be applied, and for connecting said display electrodes to a ground when said drive voltage is not applied, and said grounds for said drive circuits are connected to a common ground wiring.

23. A plasma display device according to claim 18, wherein plasma discharge occurs only between display electrode pairs.

* * * * *